US006983251B1

(12) United States Patent
Umemoto et al.

(10) Patent No.: US 6,983,251 B1
(45) Date of Patent: Jan. 3, 2006

(54) INFORMATION SELECTION APPARATUS SELECTING DESIRED INFORMATION FROM PLURALITY OF AUDIO INFORMATION BY MAINLY USING AUDIO

(75) Inventors: Azusa Umemoto, Tenri (JP); Mitsuru Minakuchi, Kyoto (JP); Naoki Urano, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/504,438

(22) Filed: Feb. 15, 2000

(30) Foreign Application Priority Data

| | | |
|---|---|---|
| Feb. 15, 1999 | (JP) | 11-036299 |
| Jun. 29, 1999 | (JP) | 11-182801 |
| Oct. 28, 1999 | (JP) | 11-306499 |

(51) Int. Cl.
*G10L 21/00* (2006.01)

(52) U.S. Cl. ..... 704/270

(58) Field of Classification Search ..... 704/270–275; 345/649

See application file for complete search history.

(56) References Cited

U.S. PATENT DOCUMENTS 5,963,215 A * 10/1999 Rosenzweig ..... 345/649
6,327,567 B1 * 12/2001 Willehadson et al. ..... 704/270

FOREIGN PATENT DOCUMENTS

| | | |
|---|---|---|
| JP | 5-273991 | 10/1993 |
| JP | 5-281987 | 10/1993 |
| JP | A6149517 | 5/1994 |
| JP | 09-097154 A | 4/1997 |
| JP | A10124292 | 5/1998 |
| JP | 11-039132 A | 2/1999 |

OTHER PUBLICATIONS

Schmandt, Chris, "Audio Hallway: a Virtual Acoustic Environment for Browsing", Proceedings of the 11th ACM Symposium on User Interface Software and Technology, Nov. 1998, San Francisco, CA, pp. 163-170.*

Goose, Stuart & Moller, Carsten, "A 3D Audio Only Interactive Web Browser: Using Spatialization to Convey Hypermedia Document Structure", Proceedings of the 7th ACM International Conference on Multimedia (Part 1), Oct. 1999, Orlando, FL pp. 363-371.*

Evans, Michael J., "Mapping an Auditory Space onto a Graphical User Interface", IEEE International Conference on Multimedia Computing and Systems, Vo. 1, Jun. 7-11, 1999, pp 807-811.*

Mynat et al., "Designing Audio Aura", Proceedings of the SIGCHI Conference on human Factors in Computing Systems, 1998, Los Angeles, CA, pp. 566-573.*

(Continued)

*Primary Examiner*—David D. Knepper
(74) *Attorney, Agent, or Firm*—Birch, Stewart, Kolasch & Birch, LLP

(57) ABSTRACT

An information presentation apparatus is provided presenting an interface suitable for selecting desired information from a plurality of information. The apparatus has three methods of presenting information. The first method is to present information by sequentially playing and presenting a plurality of audio information related to the information in turn. The second method is to present the plurality of audio information at the same time wherein each sound has its directivity. The third method is a combination of the first and second methods wherein user can select desired method between the two depending on kinds of information presented.

29 Claims, 24 Drawing Sheets

OTHER PUBLICATIONS

Pitt, Ian J. & Edwards, Allstair D.N., "Pointing in an Auditory Interface for Blind Users", IEEE International Conference on Systems and Cybernetics, vol. 1, Oct. 22-25, 1995, pp. 280-285.*

Dynamic Soundscape, Kobayashi et al., CHI 97, pp. 22-27, 1997.

Azusa Umemoto et al., "Push-based Auditory User Interfaces," Multimedia, Diffusion, Cooperation and Mobile (DICOMO '99) Symposium Proceeding, Japanese Society of Information Processing Engineers of Japan, Jun. 30, 1999, abstract only.

* cited by examiner

INFORMATION SELECTION APPARATUS SELECTING DESIRED INFORMATION FROM PLURALITY OF AUDIO INFORMATION BY MAINLY USING AUDIO

BACKGROUND OF THE INVENTION

1. Field of the Invention

The present invention relates to an information selection method selecting information associated with an audio information source, and an information selection apparatus employing such an audio information selection method.

2. Description of the Background Art

As a conventional technique of the method of selecting one information from a plurality of information, a retrieval engine using character information provided on a display is known. However, the task of continuously viewing the screen will be a burden on the user side. Accordingly, attention is now focused on the usage of voice and sound. In the case where a great number of audio media such as radio programs, music CDs and the like are the subject of selection, it will be easier for the user to actually listen to the contents rather than by selection using only character information.

A method of selecting information associated with a sound source according to a plurality of sound sources is disclosed in, for example, Japanese Patent Laying-Open No. 10-124292. According to this method, a plurality of sound sources are placed around the user. The audio outputs are basically issued at the same volume. The user distinguishes audibly the audio outputs generated simultaneously and specifies a desired direction to select the information associated with the sound of that direction. More specifically, various audio messages such as "play", "record", "rewind" and "stop" are determined for the front, right, back, and left, respectively, as the operation of a video equipment. When the user wants to effect recording, the right direction is to be selected using a pointing device such as a cross pad. Another method disclosed in this publication is devised to facilitate the audible feature of each generated sound by issuing the sound of each audio output with a slight time difference to define sound quality difference (male voice, female voice).

A method of playing again information that was missed audibly by the user indicating a certain direction with a single sound source rotating about the user is disclosed in "Dynamic Soundscape: mapping time to space for audio browsing" (CHI97) by Minoru Kobayashi and Chris Schmandt (MIT). According to this method, one sound source moves around a user while issuing audibly various topics at a constant volume and sound quality. In the case where the user missed a certain topic by the ear, the user points out the area providing the audio output of that topic using a pointing device, whereby a sound source is generated at that site. Playback is resumed from the topic that was audibly issued when passing that site of the sound source. In this playback operation, the volume of the former sound source is lowered and the sound source that newly provides the audio output effects playback at a higher volume. Both sound sources move in an orbit at the same time. Up to eight sound sources are allowed simultaneously in this system.

However, even if audio output is provided with time difference or with different sound quality corresponding to each direction to facilitate identification of the position of the sound as in the above-described publication, the direction that can be distinguished audibly by the human being is limited to eight directions at most. The case where there are a great number of selection branches cannot be accommodated. Audio output of only single words such as playback or recording as in the case of video reservation is generally of no problem. However, in the case where audio output of continuous contents such as a plurality of news programs is issued, it is difficult to audibly distinguish the contents even if the sound sources are located at less than eight directions.

In the present specification, "the position of sound" implies the site from which sound is audibly output, or a direction from which a sound can be heard.

In the above method, only one sound is audibly output unless the user provides an input. A plurality of information cannot be obtained at the same time.

The telephone push phone service is known as an information selection interface dedicated to audio (method 1). In selecting information, a voice guidance of "Please depress 1 for . . . " is output. The user depresses an appropriate button according to the voice guidance.

Another method is known to operate a system by voice using a speech recognition function (method 2). According to this method, a predetermined operation command is input through voice, or a natural language processing function is added to the speech recognition function to operate the system in the manner of ordinary conversation.

A method in which the item to be subjected to selection is altered over time is disclosed in Japanese Patent Laying-Open No. 6-149517. According to this method, the item to be subjected to selection is altered by the user or program request (output at an elapse of a predetermined time). A label of that item is displayed on the screen and a tone scale corresponding to that item is issued from a speaker. The user can select a certain item by carrying out a predetermined input operation when the label of the desired item appears.

Method 1 is disadvantageous in that the number of information that can be selected or the button to be depressed differs each time depending upon the contents. The user has to depend upon the voice guidance at every select operation, which is time-consuming. Since the number of buttons that can be depressed increases, the user will not be able to remember the location of each appropriate button. The user will have to depress the appropriate button while confirming the location of each button. This labor is tedious. Particularly in the case where it is dangerous for the user to carry out a task with his/her view off, this button position confirmation will induce danger.

Method 2 is disadvantageous in that the user must learn and operate a plurality of types of predetermined voice commands, if any is predetermined. To date, the natural language processing function lacks the ability to recognize the meaning of the word input through an audio input of high degree of freedom. A technique at the level of practical usage is not yet established.

According to the technique disclosed in Japanese Patent Laying-Open No. 6-149517, a display device is inevitable. The required information cannot be provided to the user by just through the audio output. Also, the audio information associated with each information corresponds to only the musical scale of a predetermined tone. It will be difficult for the user to master the difference of the tone and the musical interval information.

SUMMARY OF THE INVENTION

In view of the foregoing, an object of the present invention is to provide an information selection method including a user-friendly user interface employing voice in selecting one desired information out from a plurality of information.

Another object of the present invention is to provide a sound information selection apparatus that facilitates selection of desired sound information from a plurality of sound information.

A further object of the present invention is to provide a sound information selection apparatus that can have the position change of a sound controlled by the user's intention.

Still another object of the present invention is to provide an information selection apparatus that allows selection of an information source without depending upon only visual recognition.

A still further aspect of the present invention is to provide an information selection apparatus that allows the user to identify at one time more information retained by an information source.

Yet a further object of the present invention is to provide a sound information selection apparatus that allows the presentation status of sound information to be easily modified according to the user status.

Yet another object of the present invention is to provide an information selection apparatus including a user-friendly user interface employing voice in selecting one desired information from a plurality of information.

Yet a still further aspect of the present invention is to provide a computer readable recording medium including a user-friendly user interface employing voice in selecting one desired information out from a plurality of information.

According to an aspect of the present invention, a method of selecting desired information according to a plurality of sound information includes the steps of time-controlling independently the position of each sound, and selecting a sound. In selecting a sound, information associated with the sound is selected. As a result, a sound selection method can be provided that allows desired sound information to be easily selected from a plurality of sound information. Preferably, the method includes the step of controlling volume in association with the position of each sound. Information can be selected in association with the volume.

The step of controlling independently the position of each sound facilitates distinction between each sound by arranging the position of each sound on the circumference of substantially a circle to move in an orbit.

Further preferably, the position change of all the sounds can be set earlier than that of the normal time control or returned to the former position. As a result, the position change of sound can be controlled by the user's intention.

According to another aspect of the present invention, an information selection apparatus with a sound source to select desired information includes a unit time-controlling independently the position of each sound, a sound selection unit selecting a sound, and a selector selecting information associated with the sound in response to a selection signal of the sound selection unit.

According to a further aspect of the present invention, an information selection apparatus with a sound source to select desired information source from a plurality of information sources includes means for sequentially switching a plurality of information sources as audio information and presenting the same by a sound source, means for selecting audio information relevant to a desired information source from the presented audio information.

By presenting an information source as audio information by voice, an information source can be selected without depending upon only visual recognition. By selecting that audio information when presented, an information source can be selected by unitary operation.

Preferably, the information selection apparatus includes means for indicating switching of the audio information.

This allows switching of the audio information by an indication of the user. Audio information can be presented at a timing suiting the user's wishes.

Further preferably, the switch specify means specifies presentation of audio information presented after or before the currently-presented audio information.

Accordingly, switching can be effected by the user's specification so as to present audio information that was to be presented afterwards or that is already presented during presentation of audio information. Therefore, the user can sequentially refer to information according to his/her wishes. This switching is not limited to audio information immediately preceding or succeeding the currently-presented audio information. Several audio information can be skipped by rewinding or fast-forwarding to present an appropriate audio information.

Further preferably, the information source retains information other than the audio information. The information selection apparatus can present the other information when the desired audio information is selected.

By presenting information other than the voice information such as image information retained by the information source, another information of audio information that is not presented can be provided in addition to the another information of the currently-presented audio information. Thus, the user can identify at one time more information retained by the information source.

The information other than the audio information retained by the information source is preferably image information. Information depending upon the five senses of the user (the tactual sense, the palate, the sense of smell) is allowed as long as it conveys information. For example, information can be presented by conducting a current through the clothing of the user, the scent, the taste, or the like.

According to the information stored in information storage unit 816, main control unit 812 commands play control unit 815 to play the audio information stored in audio storage unit 811 or to play the audio which is the contents of information storage unit 816 converted by audio conversion unit 814.

By presenting information other than audio information such as the image information retained by the information source during presentation of that audio information, the user can identify at one time more information retained by the information source.

According to still another aspect of the present invention, an information selection method includes the step of gradually narrowing down the information from categorized information sources by repeating the information selection method.

By gradually narrowing down the information out from categorized information sources, the user can easily arrive at the desired information out from a large amount of information sources.

According to a still further aspect of the present invention, a recording medium can be applied in which a program is recorded to cause a computer to execute the step of sequentially switching a plurality of information source as audio information and presenting the selected information source by a sound source, and the step of selecting from the presented audio information the audio information relevant to desired information source.

According to yet a further aspect of the present invention, an information presentation apparatus presenting a plurality of information as sound information includes a unit to modify, in presenting sound information, the presentation status according to the property of the sound information to be presented or the user status.

Accordingly, the presentation status of sound information can be easily modified according to the property such as the length volume, stereo/monaural audio, and sampling frequency of the audio information to be presented and the sound quality depending upon the reproduction hardware, or according to the user status such as the case where the user is aware or not aware of the information preceding or succeeding the information to be presented, or the acceptability of the information applied as sound to the user.

Preferably in the information presentation apparatus, the presentation status to be modified includes either the status of presenting at the same time the plurality of sound information with the presentation position changed, or the status of sequentially presenting the plurality of sound information.

By selecting the status of presenting sound information simultaneously or sequentially, the sound information can be presented, not in an inflexible manner, but in a more appropriate manner suiting the situation when the information is to be presented as audio output.

Further preferably, the information presentation apparatus includes an arrangement unit time-controlling independently the position of sound information for arrangement in presenting the plurality of sound information at the same time with the presentation position changed. The position of each sound is arranged on the circumference of substantially a circle to move in an orbit. The rotation condition and sound placement condition are set according to the property of the sound information to be presented.

By arranging the sound information on the circumference of a circle to move in an orbit with the user present at a certain contact point of that circle, the user himself/herself can easily recognize the mutual position relationship of the sound such as the most closest sound information position, the farthest sound position information, and the like in presenting a plurality of sound information at the same time. By setting the rotation condition such as the rotation speed or rotation radius, and the sound placement condition such as the distance between sounds, an information presentation environment suiting each user can be established.

The circle on which the sound information is to be arranged does not have to be a complete circle. Depending on the number of sound information presented at the same time or the user's preference, sound information can be presented with the portion of the circumference of the circle that is most remote from the user cut.

Further preferably, the information presentation apparatus includes an arrangement unit time-controlling independently the position of sound information in presenting a plurality of sound information with the presentation position altered. The position of each sound is modified to the position specified by the user independent of rotation of the position of the sound information.

By the provision of means for modifying the position of each sound to a position specified by the user independent of the rotation, i.e., without waiting for the orbital motion, sound information associated with the desired information can be obtained immediately within the reach of the user, i.e., obtained at one step without having to depress the "rewind", "forwarding" buttons several times.

Various information selection is allowed according to the information presentation apparatus such as directly calling up another sound from a slight position change of all the sounds being presented.

According to yet another aspect of the present invention, an information presentation apparatus groups, when there is difference in the property between each sound information retained by the information, the property of each sound information prior to presenting the sound information.

By grouping the property of each sound information and presenting the normalization as sound information after monauralizing the stereo audio in advance when stereo audio and monaural audio are mixed in the sound information in the case where there is difference in the volume level of the sound information, the user can recognize the placement position of the sound information for all sound information.

Preferably, the information includes presentation information other than the sound information in the information presentation apparatus. The presentation information other than the sound information can be displayed together in displaying each sound information.

By presenting together presentation information other than sound information such as image information or information by touch, the user can obtain more easily the desired information.

Further preferably, the information presentation method presenting a plurality of information as at least sound information includes the step of modifying, in presenting sound information, the presentation status according to the property of the sound information to be presented.

According to yet a still further object of the present invention, a computer readable recording medium is provided in which a program is recorded to cause a computer to execute the step of presenting a plurality of information as sound information, and the step of modifying the presentation status of the sound information to be presented according to the property thereof.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

First Embodiment

Figure 1:
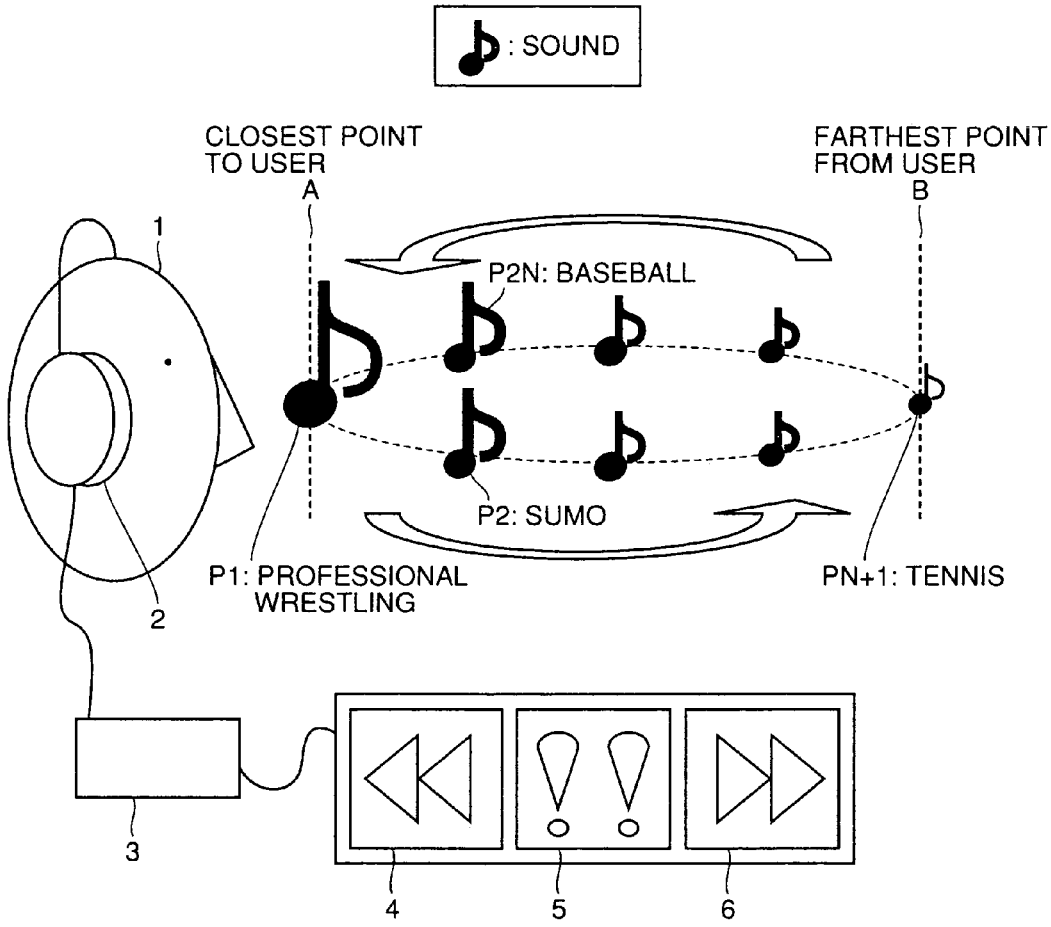
FIG. 1 is an operation image diagram according to a first embodiment of the present invention.

Referring to FIG. 1, a user 1 listens to a plurality of sounds controlled by a control device 3 through a headphone device 2. A controller including a rewind button 4, a select button 5, and a fast-forward button 6 is provided in control device 3. Control device 3 carries out the operation to realize the left and right volume adjustment of headphone device 2 or a stereo speaker so as to allow user 1 to recognize sounds P1–P2N located on a horizontal plane in the front direction of user 1, and provides control to effect simultaneous play as if the plurality of sounds P1–P2N at a constant interval move in an orbit. In controlling the rotation of the orbit, the volume is altered according to the rotation so that the volume of a certain sound P is set to the maximum when at a point A closest to the user and to the lowest volume when at a point B farthest from the user. The volume is repeatedly increased and lowered gradually to attain the largest volume at point A and the lowest volume at point B. The relationship of the volume of each sound in FIG. 1 is established as P1>P2> . . . >PN>PN+1< . . . <P2N, P2N<P1. This process corresponds the steps up to S121 in FIG. 2.

Figure 2:
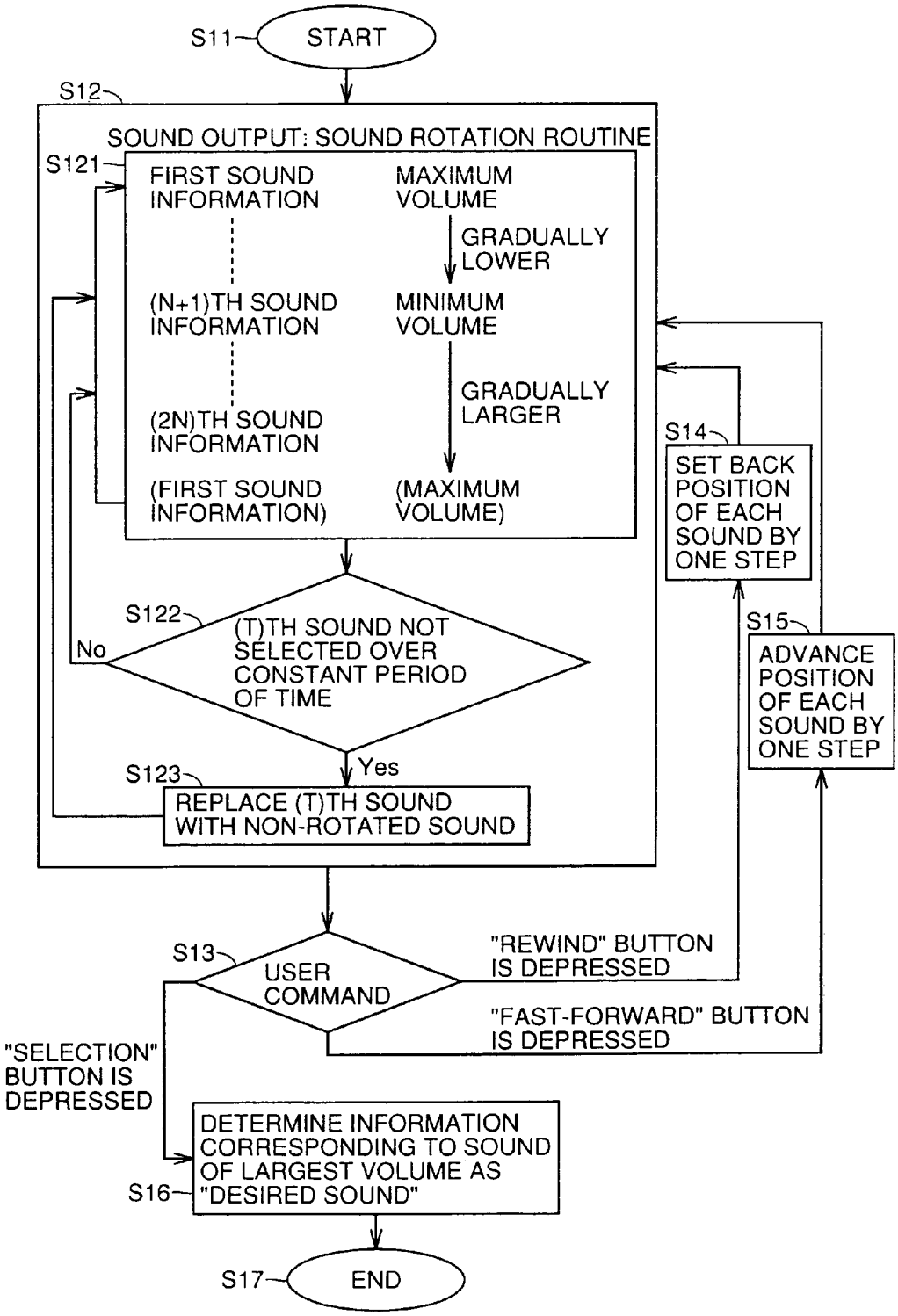
FIG. 2 is a control flow chart describing the operation of the first embodiment.

FIG. 2 is a control flow chart describing the operation of the first embodiment. A sports program guidance of a multichannel broadcast will be taken as an example with reference to FIGS. 1 and 2. Music or sound corresponding to each sport such as the theme song of a professional wrestler for a professional wrestling match program, the beat of a drum issued at the start of the sumo tournament for a sumo broadcast are prepared to move in an orbit as sound. Also, the sound may be the audio output per se of each broadcast. Here, it is assumed that sound P1 corresponds to the theme song of a professional wrestler, P2 corresponds to the drumbeat for sumo, PN+1 corresponds to the sound of a tennis ball hitting a racket, and P2N corresponds to the song for supporters of a baseball team.

At step S12, sounds differing in volume move in an orbit as described above. At step S13, the depression of select button 5 at the status of FIG. 1 when the user decides to select a professional wrestling match program at the maximum volume causes a process to be carried out in which the professional wrestling match is handled as the desired information (S13, S16, and S17 in FIG. 2). When another sport is to be selected at the status of FIG. 1, the user waits until the desired program is heard at the largest volume or returns the position of each sound to one previous step using fast-forward button 6 or rewind button 4 to obtain the greatest audible output of the program that is to be selected (S14). Then, the position of each sound is advanced by one step (S15). Next, select button 5 is depressed. When a baseball game program, for example, is to be selected at the status of FIG. 1, the user waits a little or depresses fast-forward button 6. When the sumo program is to be selected, the user either waits for a rather long time or depresses rewind button 4 or fast-forward button 6 for the adjustment. Alternatively, selection switches corresponding to respective positions of each sound can be provided so that the user can depress an appropriate selection switch corresponding to the sound that is to be selected. In this case, the desired sound can be directly selected.

Figure 5A:
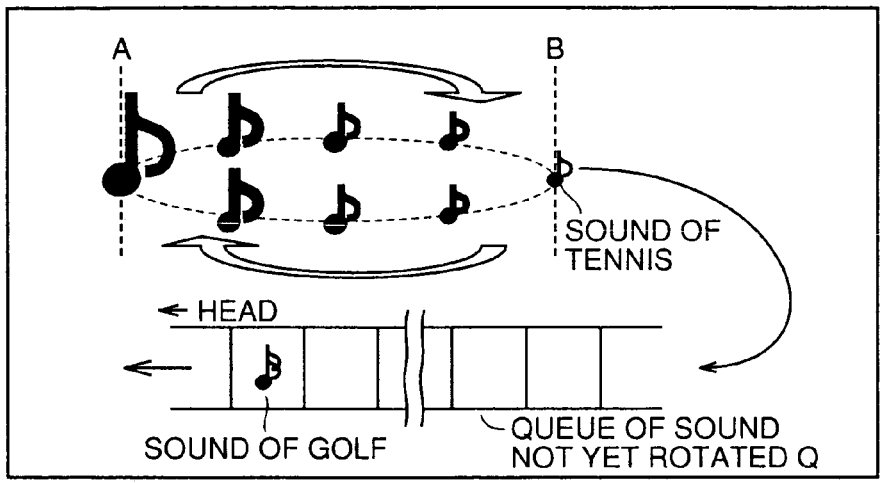
FIGS. 5A–5C are operation image diagrams of details of the first embodiment.
Figure 5B:
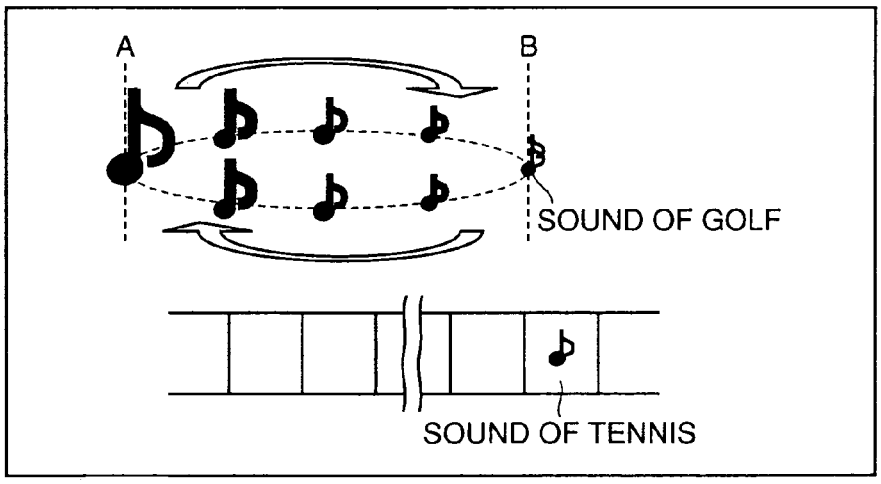
Figure 5C:
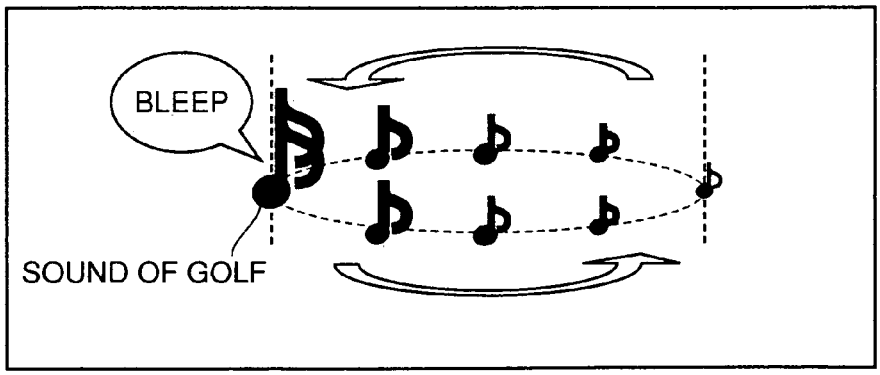

Referring to step S12 of FIG. 2 again, only a predetermined number of programs can be extracted to move in an orbit for selection when there are so many programs that it is difficult for a simultaneous orbital motion of all the programs such as in the case of a movie broadcast guidance of a multichannel broadcast. By replacing at a point B most remote from the user the sound that has not been selected over a predetermined period with information that is not yet included in the orbit, one information can be selected from a great many selection branches (S122, S123 in FIG. 2). In this case, a notify sound that does not disturb the information audit output is sounded in order to indicate that the information has been revised. This method will be described with reference to FIGS. 5A–5C. When the tennis program has not been selected over a predetermined time in the above-described sports program guidance (refer to FIG. 5A), the sound at the head of the sound queue Q (for example, the sound of a golf program) is extracted from queue Q to move in the orbit instead of the tennis program. The sound of the tennis program is set back to the end of queue Q (FIG. 5B). At the time when the sound of the golf program attains the maximum volume for the first time, the notify sound is issued together to indicate that is a new program on the orbit(FIG. 5C).

Second Embodiment

Figure 3:
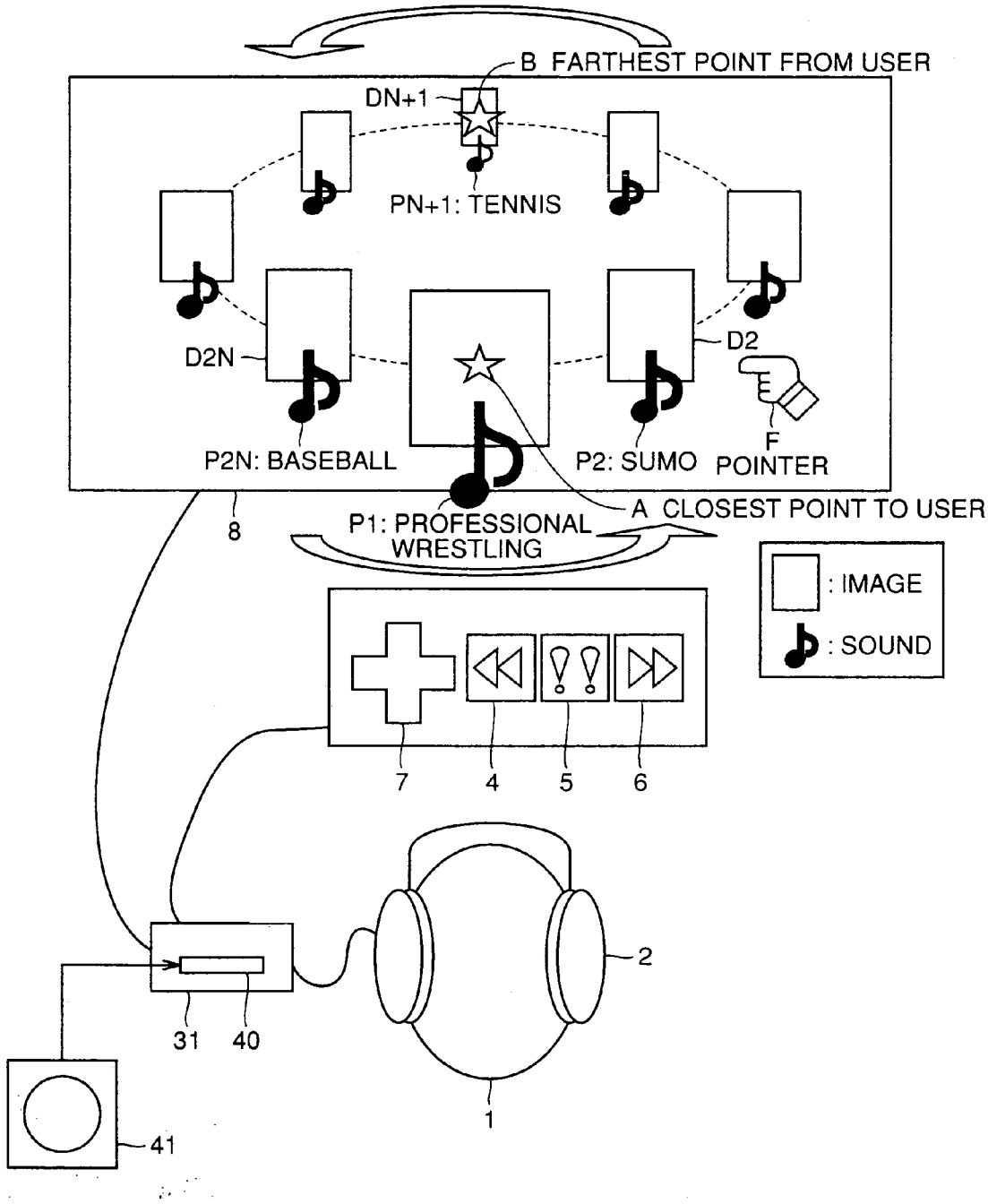
FIG. 3 is an operation image diagram according to a second embodiment of the present invention.
Figure 4:
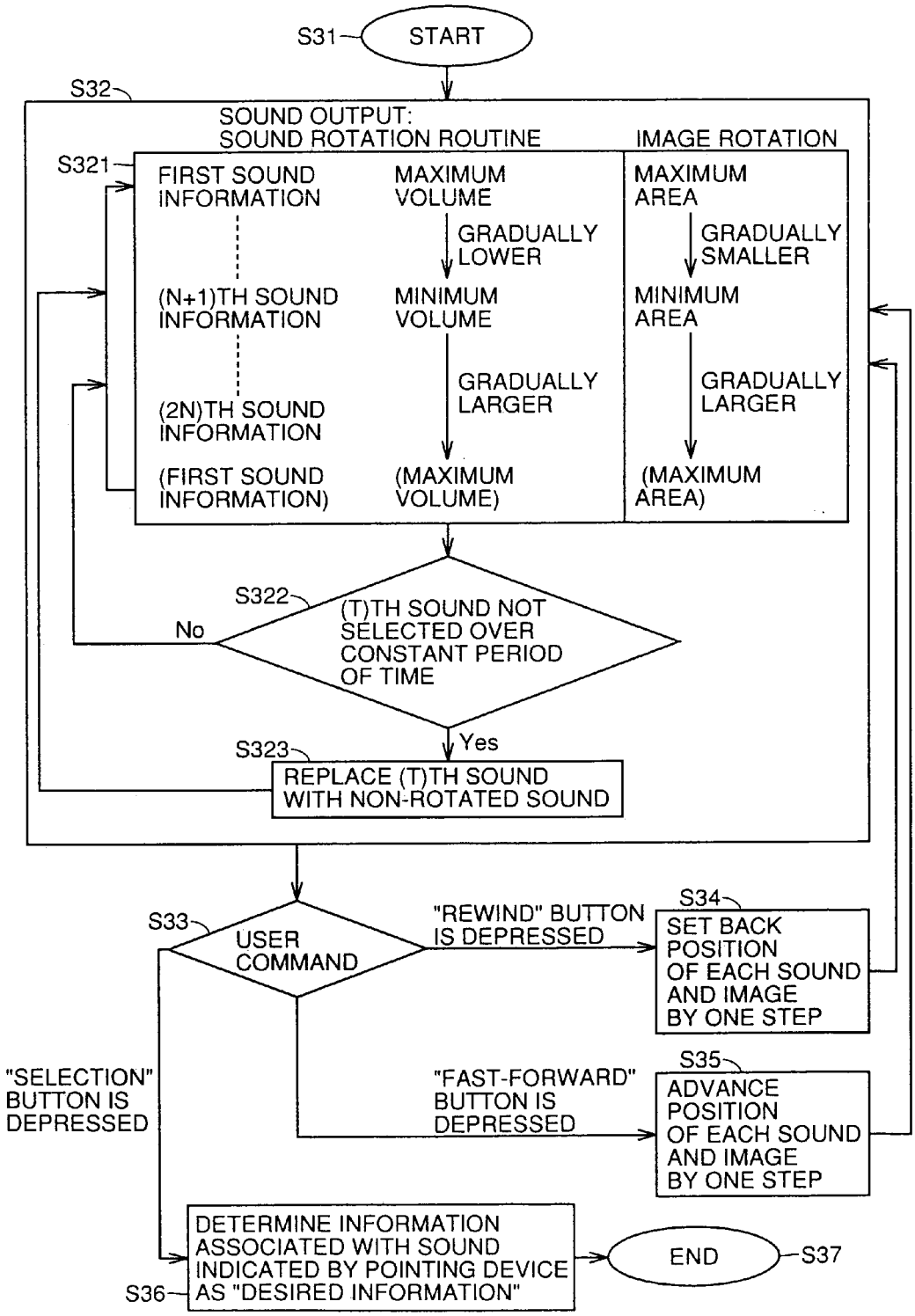
FIG. 4 is a flow chart to describe the operation of the second embodiment.

A second embodiment of the present invention will be described with reference to FIGS. 3 and 4. In the present second embodiment, an image is employed in addition to the sound for the purpose of information selection. A controller including a rewind button 4, a select button 5, a fast-forward button 6, a cross pad 7, and a display device 8 is provided in a control device 31. User 1 views a plurality of images and hears sound under control of control device 31 through headphone device 2 and display device 8. Control device 31 provides control to move images D1–D2N in an orbit corresponding to sounds P1–P2N, respectively, orbiting at a constant interval in synchronization with the sound using display device 8 to display the image information (S321 in FIG. 4). Correspondence between the volume and an image is established so that the image is displayed with the largest area when at the maximum volume. Thereafter, the volume is gradually lowered to attain the lowest level of volume. Corresponding to this change in the volume, the area of the corresponding image becomes gradually smaller than the largest area to eventually attain the smallest area. Then, the volume and the area gradually become larger to attain the largest volume and area.

In the case where the user is to select information, the user operates a pointer F on display device 8 using a pointing device such as a cross pad 7, for example, to directly select an image on display device 8. Alternatively, when that user wishes to select another sports program under the status of FIG. 3, the user waits until the desired image is exactly in front and the sound is heard at the largest volume. Instead of waiting, the user can return(S34) or advance(S35) the position of each image and sound by one step to let the desired information to be located in front and hear the sound at the largest volume using fast-forward button 6 or rewind button 4. Then, select button 5 or cross pad 7 is depressed. In response, the information associated with the sound designated by cross pad 7 is determined as "the desired information" (S36). For example, when a baseball program is to be selected under the state of FIG. 3, the user waits for a short time or depresses fast-forward button 6. When a sumo program is to be selected, the user waits for a longer period of time or depresses rewind button 4 or fast-forward button 6 for adjustment.

Referring to step S32 of FIG. 4 again, only a predetermined number of programs can be extracted to move in an orbit for selection when there are so many programs that it is difficult for a simultaneous orbital motion of all the programs such as in the case of a movie broadcast guidance of a multichannel broadcast. By replacing the sound that has not been selected over a predetermined period with information that is not yet included in the orbit at a point B most remote from the user, one information can be selected from a great many selection branches (S322, S323).

When categorization is possible in the case where there are many selection menus, an index of the categories is produced by the sound corresponding to a read out of the label of each index. By selecting that sound, the contents of a relevant category can be made to move in an orbit as a certain sound.

Control device 31 may be a personal computer. A drive device 40 of a recording medium 41 is provided at personal computer 31. A program to cause the personal computer to carry out an operation according to the control flow shown in FIG. 4 is recorded in recording medium 41. This applies also to the other embodiments described hereinafter.

Figure 6A:
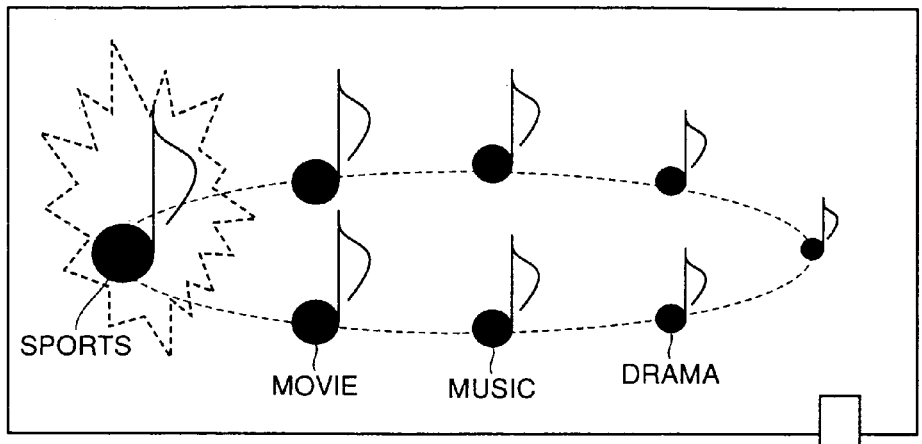
FIGS. 6A–6C are operation image diagrams of menu hierarchy.
Figure 6B:
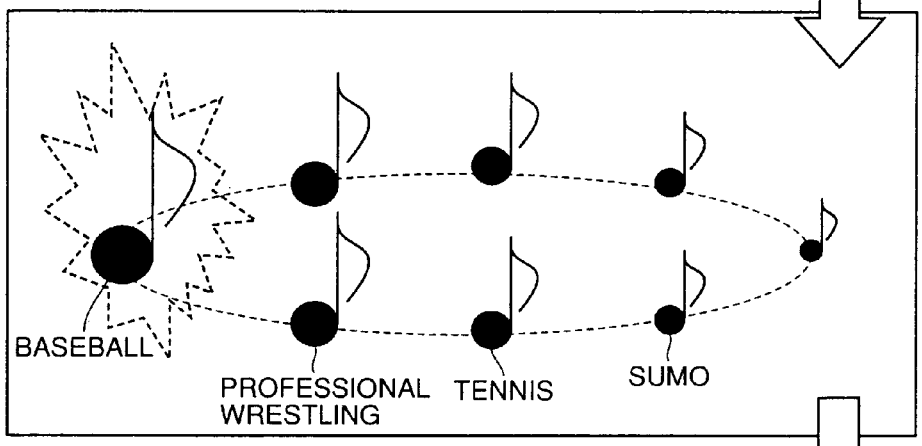
Figure 6C:
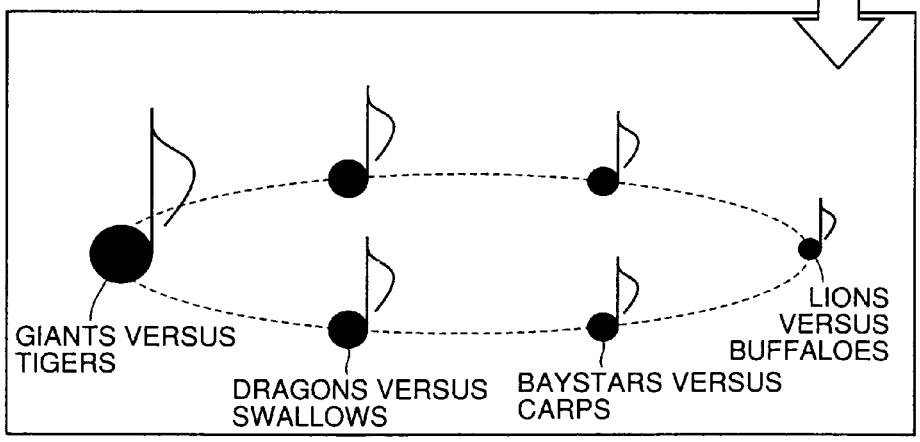

FIGS. 6A–6C are operation image diagrams of specific examples. Referring to FIG. 6A, it is assumed that a sound indicating the category of sports is selected from the menu of sports, movies, music, and drama. Upon selecting that sound, the contents of the relevant category, i.e., the sounds of a baseball program, professional wrestling program, tennis program, sumo program and the like are moved in an orbit. Upon selecting the sound indicating a baseball program in FIG. 6B, the sound of a baseball match such as Giants versus Tigers, Dragons versus Swallows, Baystars versus Carps, Lions versus Buffaloes corresponding to the lower hierarchy of the category move in an orbit(FIG. 6C).

Figure 7:
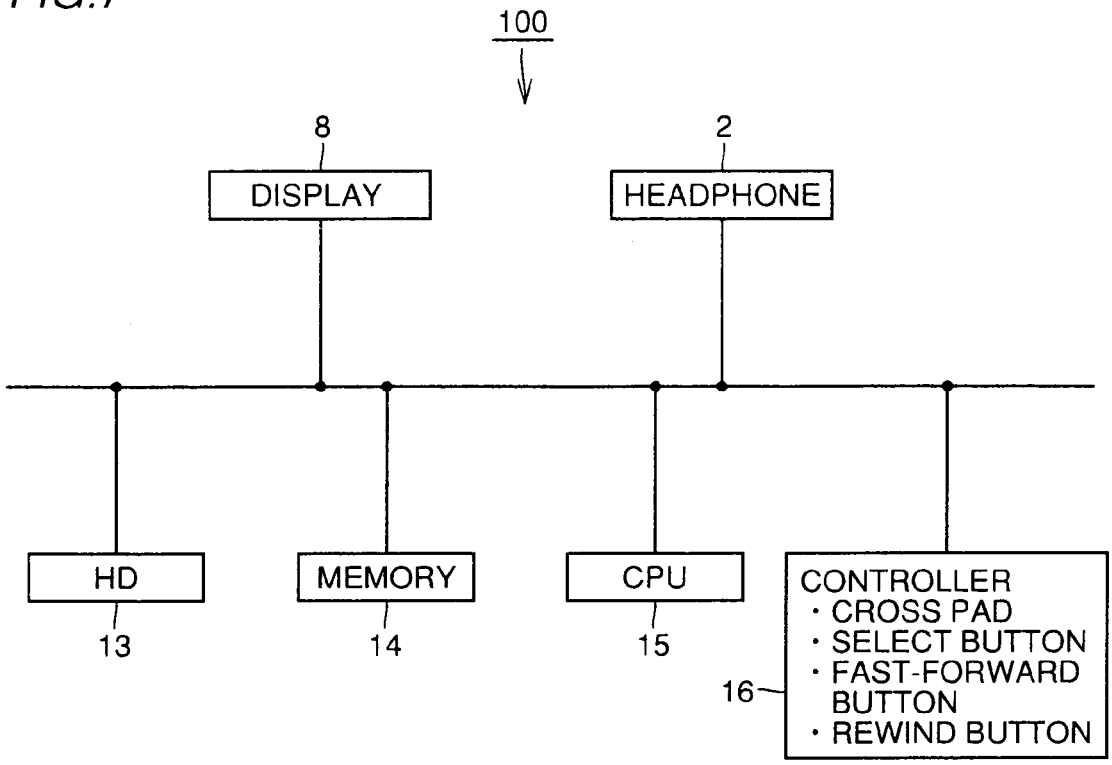
FIG. 7 is a diagram of a structure of an audio selection apparatus.

Following the above description of the method of the first and second embodiments, an apparatus realizing the present invention will be described hereinafter with reference to FIG. 7. Referring to FIG. 7, a sound information selection apparatus 100 includes a display 8, a headphone 2, a hard disk 13, a memory 14, a CPU (central processing unit) 15, and a controller 16 with a cross pad, a select button, a fast-forward button, and a rewind button. A program is supplied via a network or from hard disk 13 in the form of a program medium to be stored in memory 14. CPU 15 reads the program on memory 14 to control the volume and rotation of a plurality of sounds and supplies the information to headphone 12. Also, a plurality of images corresponding to the plurality of sounds are adjusted in size and rotation to be supplied to display 11. Upon indication from controller 16, CPU 15 determines that the sound and image specified at controller 16 is the desired information of the user.

Third Embodiment

Figure 8:
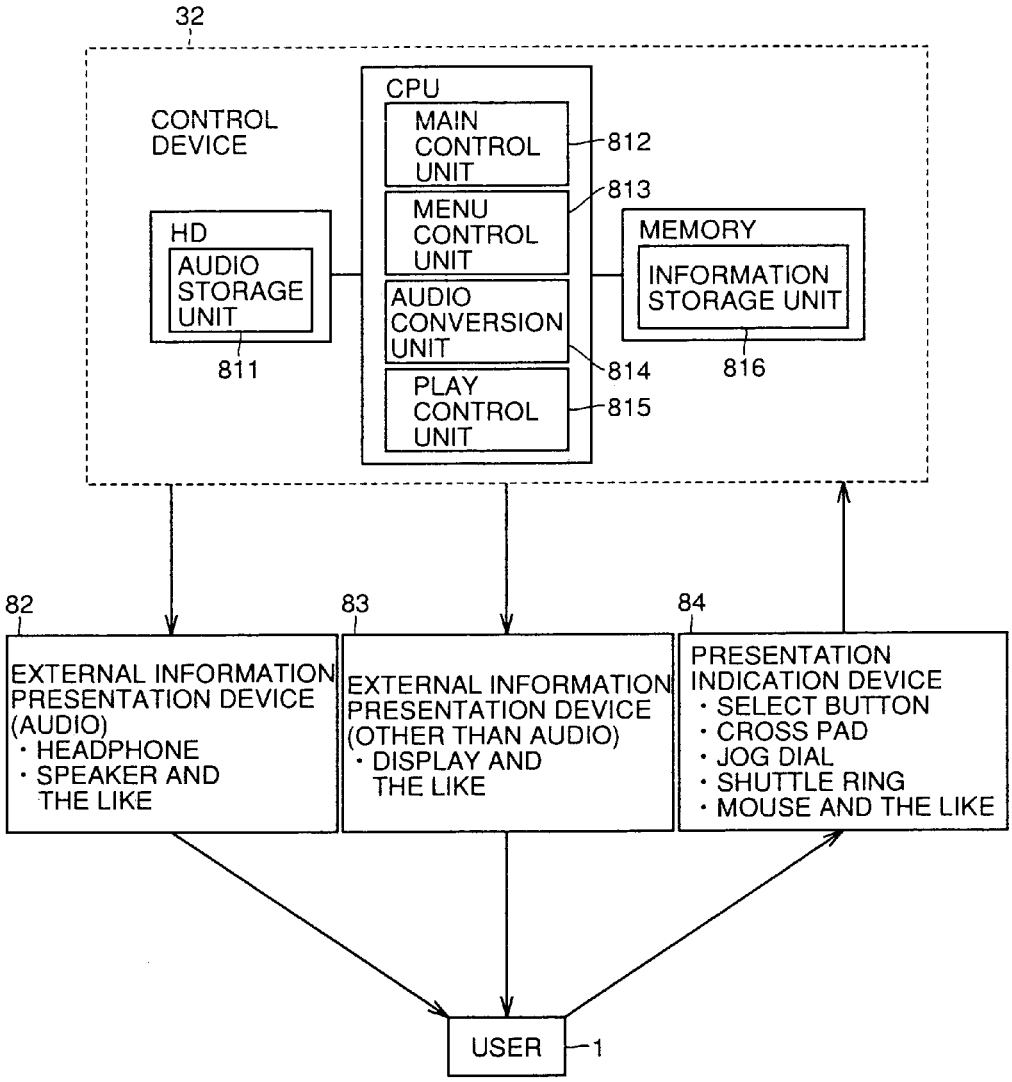
FIG. 8 is a block diagram of an audio information selection apparatus according to a third embodiment of the present invention.

FIG. 8 is a block diagram showing the main part of an audio information selection system according to a third embodiment of the present invention. The audio information selection system includes a control device 32, an external information presentation device 82 directed to audio presentation, an external information presentation device 83 directed to presentation other than audio information, and a presentation indication device 84. Control device 32 includes an audio storage unit 811, a main control unit 812, a menu control unit 813, an audio conversion unit 814, a play control unit 815 and an information storage unit 816. External information presentation device 82 includes a headphone, a speaker, and the like for audio presentation. External information display device 83 includes a display or the like for presentation of information other than audio information. Presentation indication device 84 includes a select button, a cross pad, a jog dial, a shuttle ring, a mouse, or the like. In FIG. 8, control device 32 is connected to external information display devices 82, 83 and presentation indication device 84 with one machine by means of a cable. The present invention is not limited to such a connection, and mutual connection can be established through cable, network, or radio (wave, IR, and the like) communication.

According to the information stored in information storage unit 814, main control unit 812 commands play control unit 815 to play the audio information stored in audio storage unit 811 or to play the audio which is the contents of information storage unit 814 converted by audio conversion unit 812.

When there is an input from presentation indication device 84, or when there is a command from main control unit 812, play control unit 815 is directed to switch the presentation information according to menu control unit 813 for playback.

Figure 9:
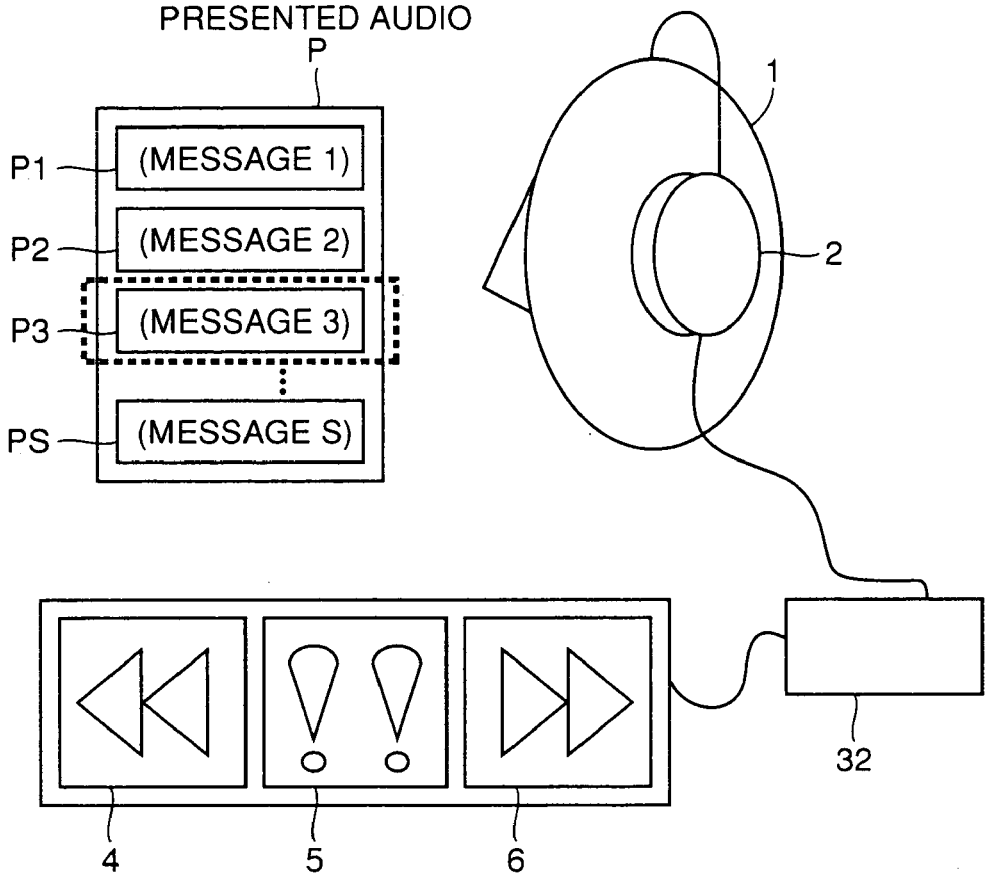
FIG. 9 is an operation image diagram of the third embodiment.

The operation of the third embodiment will be described hereinafter with reference to FIG. 9.

User 1 listens to the audio information sequentially presented by control device 32 through headphone device 2. This differs from the operation of the previous first and second embodiments. Control device 32 includes a controller with a rewind button 4, a select button 5, and a forward button 6. Control device 32 sequentially switches the audio information corresponding to a plurality of information sources. More specifically, when there is a total of S information P to be presented, information P is sorted from P1 to PS. Control device 32 sequentially switches the information for presentation such as presenting information P2 following the presentation of P1, presenting information P3 following the presentation of P2, . . . .

The sorting sequence (arranged order) of the information presented to the user may reflect the user's preference corresponding to a preceding selection.

Figure 10:
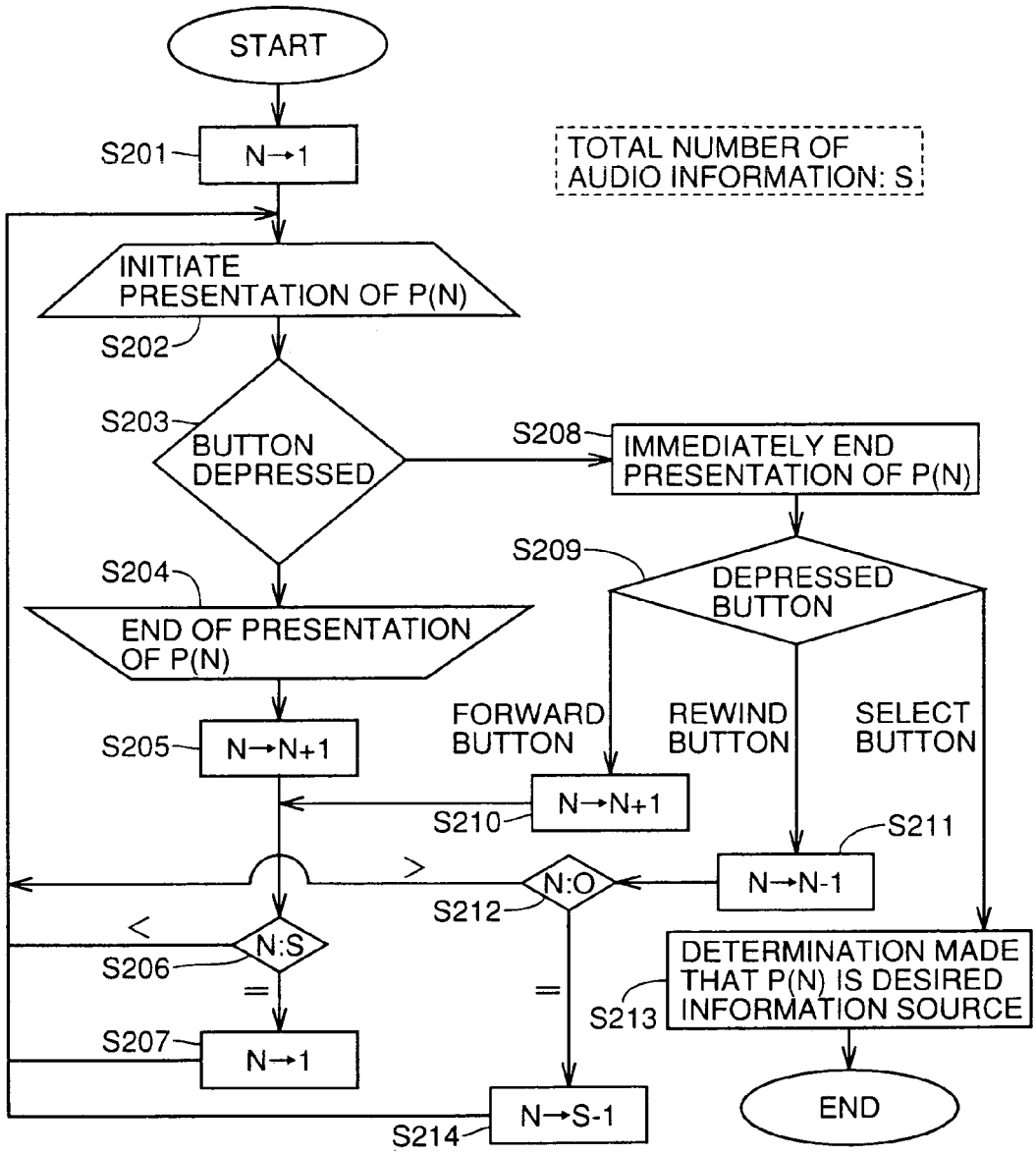
FIG. 10 is a control flow chart describing the basic operation of the third embodiment.

FIG. 10 is a control flow chart describing the operation of the third embodiment. An example is taken when the Nth information PN is presented. Upon activation of the system, presentation is initiated from the first information in the order of all the sorted information to be presented (S201). When a button is not depressed during presentation of information PN, information PN+1 is set as the next information to be presented (S205). When N+1 exceeds S, i.e., when presentation up to the Sth information has been effected, the first information is presented again(S207). When a button is depressed during presentation of PN, presentation of PN is suppressed immediately (S208). When the depressed button is the rewind button, the next information to be presented is information PN−1 (S211). When N−1 is 0, i.e., when N is 1, the Sth information is to be presented next (S214). When the depressed button is the forward button, the next information to be presented is PN+1 (S210). In the case N+1 exceeds S, the aforementioned operation is carried out (S207). When the depressed button is the select button, determination is made that information PN is the information desired by the user (S213).

Fourth Embodiment

Figure 11:
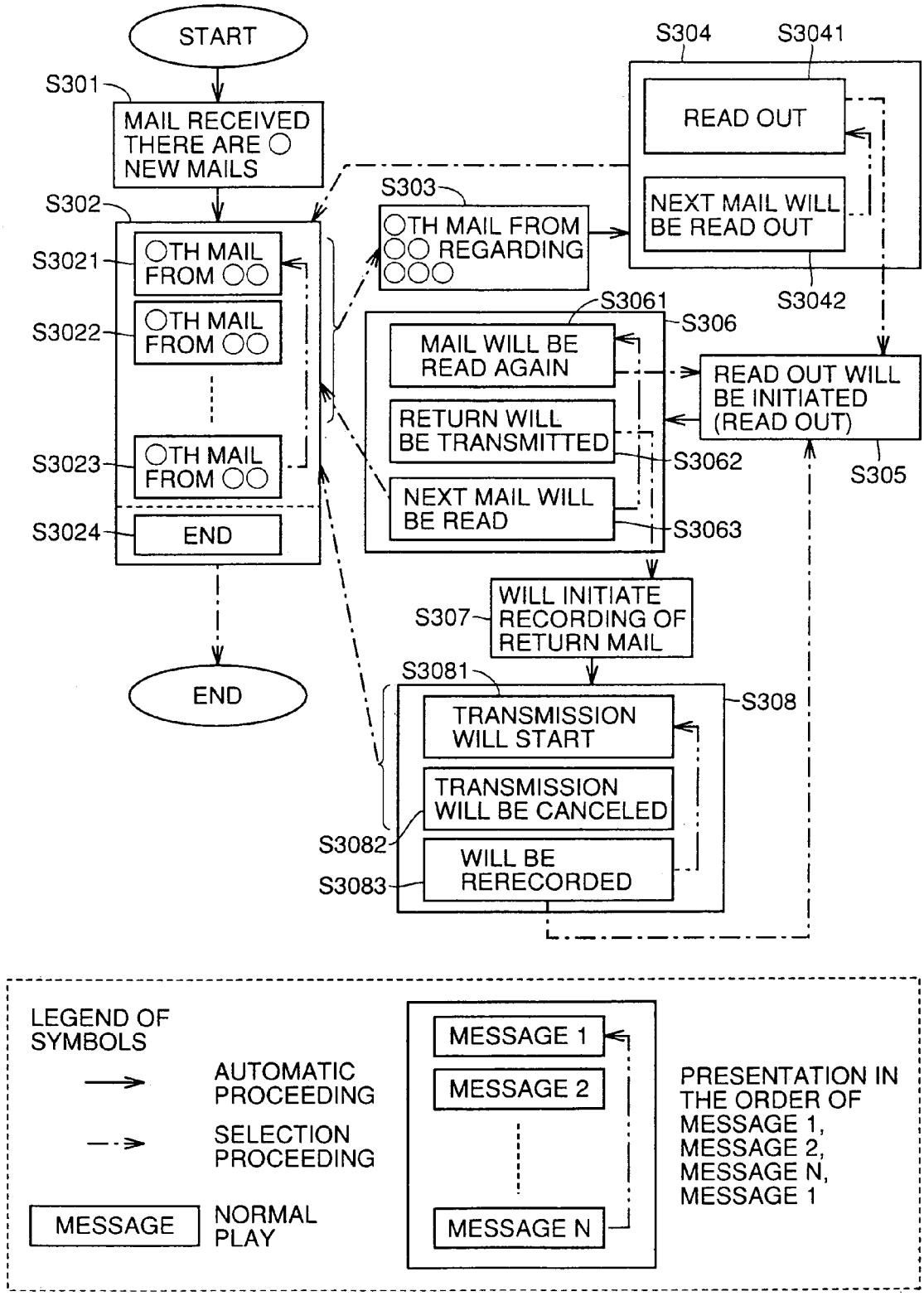
FIG. 11 is a control flow chart showing the modifying manner of the presented information when the present invention is applied to a mail application.

FIG. 11 corresponding to a fourth embodiment of the present invention shows the operation flow in a mail application. The method described with reference to FIG. 10 is repeatedly employed in this example. A mail application will be described hereinafter with reference to FIGS. 9, 10 and 11 as exemplary of the present invention. Upon initiating the application, notification is made of how many mails there are by voice (S301). A voice reading out information of the sender such as "○○th mail from ○○ (name) . . . " and a message "END" that ends the application are prepared as the subsequent audio information to be presented. An appropriate audio information is sequentially presented (S302). When the user selects one mail according to the above-described selection means, the date, the name of the sender and label of the selected mail are read out (S303). Then, a message indicating the process with respect to that mail is presented as the audio information (S304). In a similar manner thereafter, the information that can be selected is automatically presented, and the user specifies a selection to proceed the operation using the aforementioned selection means. When it is not necessary to listen to the message from the beginning to the end in order to ascertain the contents of the information, forward button 6 is to be depressed during the presentation of the information. In response, the currently displayed information is skipped to facilitate presentation of the next information. In the case where the user cannot remember the contents of the information already output audibly, rewind button 4 can be depressed to allow presentation of information that is already presented. For example, when the user fails the operation of recording a return mail and wishes to record again, presentation of other messages such as "Transmission is to proceed (S3081)" and "Transmission is canceled (S3082)" can be skipped by means of forward button 6 to obtain immediately the presentation of "Start recording over again (S3083)". Alternatively, the presentation order of the information can be followed in the opposite direction using rewind button 4 for presentation.

By providing three operation buttons which are actually presented by voice and selecting appropriate audio information to proceed the operation, an interface that alleviates the confirmation task of the operation buttons and that can be specified audibly is realized.

By dividing the information presentation into four stages, i.e., presentation of a plurality of mails (S302) and a menu of operations for the selected mail (S304, S306, S308), the required information can be presented to the user corresponding to each situation. Selection of the mail per se and the operation with respect to the selected mail can be effected according to the same method and same buttons.

The operation of the memory will be described with reference to FIGS. 8 and 11 hereinafter.

According to the contents of information storage unit 816, main control unit 812 provides control to enter the number of mails in the appropriate portion of the information "A new mail has arrived. There are now ○○ new mails." (S301) The information is converted into an audio message at audio conversion unit 812, and play control unit 815 is commanded to play the converted audio message. Then, information of a list of the senders of the received mails stored in information storage unit 816 and that are now converted to the voice of "○○th mail, from ○○" through audio conversion unit 812 (S3021–S3023), and also the message of "End" stored in audio storage unit 811 (S3024) are stored in information storage unit 816 as the mail selection menu.

Menu control unit 813 directs play control unit 815 to play in order each information in the stored audio menu S302.

In the case where user 85 depresses the select button in presentation indication device 84 during playback of the voice reading out the name of the mail sender (S3021–S3023), main control unit 812 makes an inquiry to information storage unit 816 as to the label information corresponding to the mail that was currently displayed when the user depressed the button. The relevant information is converted into a voice message indicating the number, sender name, and title label of the selected mail such as "○th mail from ○○ regarding ○○" (S303) via audio conversion unit 812. The converted audio information is stored in information storage unit 816 and played by representation control unit 815.

Then, the voice information reading out the operation that can be carried out with respect to the selected mail such as "Read out (S3041)", "The next mail will be read out (S3042)" is provided from audio storage unit 811, and stored in information storage unit 816 as the function menu (S304). Menu control unit 813 directs play control unit 815 to play in each sequential order the operations in function menu (S304) stored in information storage unit 816.

In a similar manner thereafter, the voice menu is read into information storage unit 816 according to the instruction of user 85, and audio presentation is directed by menu control unit 813.

The fixed messages of S3024, S304, S305, S306, S307 and S308 in FIG. 11 are already stored in audio storage unit 811 as audio messages. In the case of presentation, the audio message is directly read into information storage unit 816 and played by play control unit 815.

In contrast, the messages of S301, S3021–S3023 and S303 differ according to the contents of the mail. The mail contents stored in information storage unit 815 are converted into appropriate speech via audio conversion unit 814. The converted audio information is stored in information storage unit 815 and played by play control unit 815.

Here, audio conversion unit 814 applies voice synthesization on the text since mail is handled in the present embodiment. Not only voice synthesization, but audio other than the human voice can be handled depending upon the information of interest.

The present invention is not limited to a mail application, and is also applicable to the program guidance and the like of music CDs and multichannel broadcasting.

Fifth Embodiment

Figure 12:
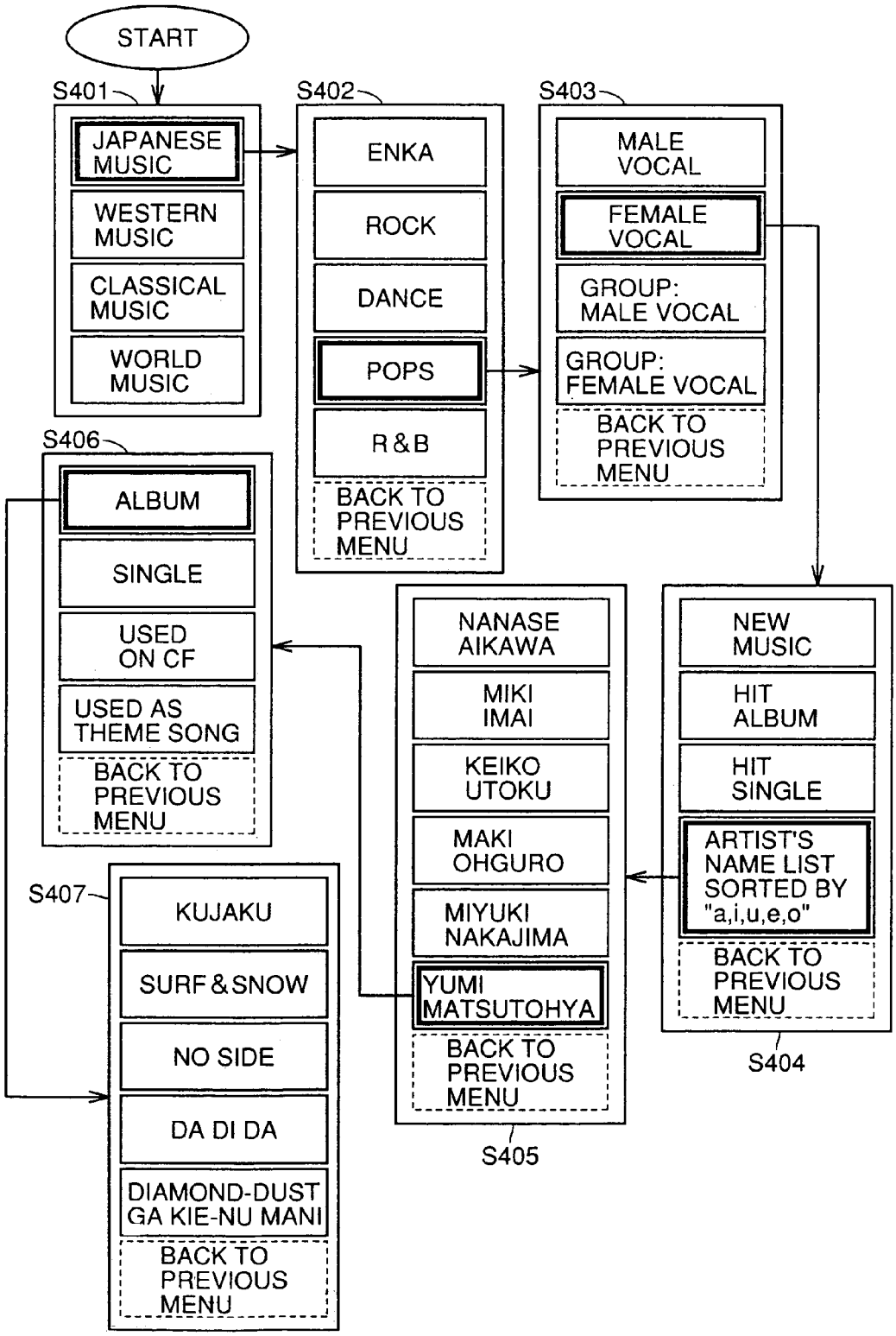
FIG. 12 is a control flow diagram showing the modifying manner of the presented information when the present invention is applied to music CD retrieval.

FIG. 12 shows the invention of the third embodiment applied to a music CD retrieval system as the fifth embodiment. Upon initiating the system, a voice reading out the genre is presented as information (S401). Upon selecting Japanese music therefrom, a genre of a more detailed level of Japanese music is presented (S402). In a similar manner thereafter, the operation of selecting an index of a category is repeated to select the desired information. It is to be noted that the information at S402 and S405 in FIG. 4 are not the voice synthesization of the index in the category. The audio output of a CD can be used as an index since a keypart of the music in the CD can provide the identification of the contents of that information. Thus, when there are many information that is the target of search, the information can be categorized to provide an index to the user. Accordingly, the desired information is presented to the user. As to the operation of returning to the former operation (return to the hierarchy of one higher level), a button for the function of returning to one previous step can be added to rewind button 4, select button 5 and forward button in FIG. 9. In the case where return to one previous hierarchy is allowed, the audio information of "Return to one previous menu" is presented together with the information to be presented. The user can return to the previous hierarchy by selecting that information.

According to the example of FIG. 12, desired music information can be obtained by dividing the indexes into seven stages of S401, S402, S403, S405, S406 and S407 of the menu that can be selected. Also, by adding the message of "Return to one previous menu" in the index information of the seven stages, the information itself can be handled at a level identical to that of the system operation command.

One or a plurality of the "Return to one previous menu" message can be prepared in a series of indexes. When there is a great number of indexes, this message can be prepared at a constant interval.

In the case where the present invention is applied to the program guidance of a multichannel broadcast, indexes such as for each genre, target age and the like can be prepared in addition to the indexes for each channel and time to facilitate the user's selection of a desired program. The index label may be presented in the form of a synthesized speech, or in the form of the exact audible output of the program.

When a list of the programs that is currently being broadcasted is to be presented according to the method of the present invention, presentation can be provided in a fashion switching the channel for every predetermined time. Alternatively, an audio output characteristic of respective programs can be presented as the program information. In this case where the program of a certain channel changes to another program of that same channel over time, the audio output of the new program is sequentially presented corresponding thereto.

Sixth Embodiment

The sixth embodiment is directed to presenting information visually and audibly using visual information in addition to the auditory information. The sixth embodiment employing visual information in a supplementary manner will be described hereinafter with reference to FIGS. 13 and 14.

Figure 13:
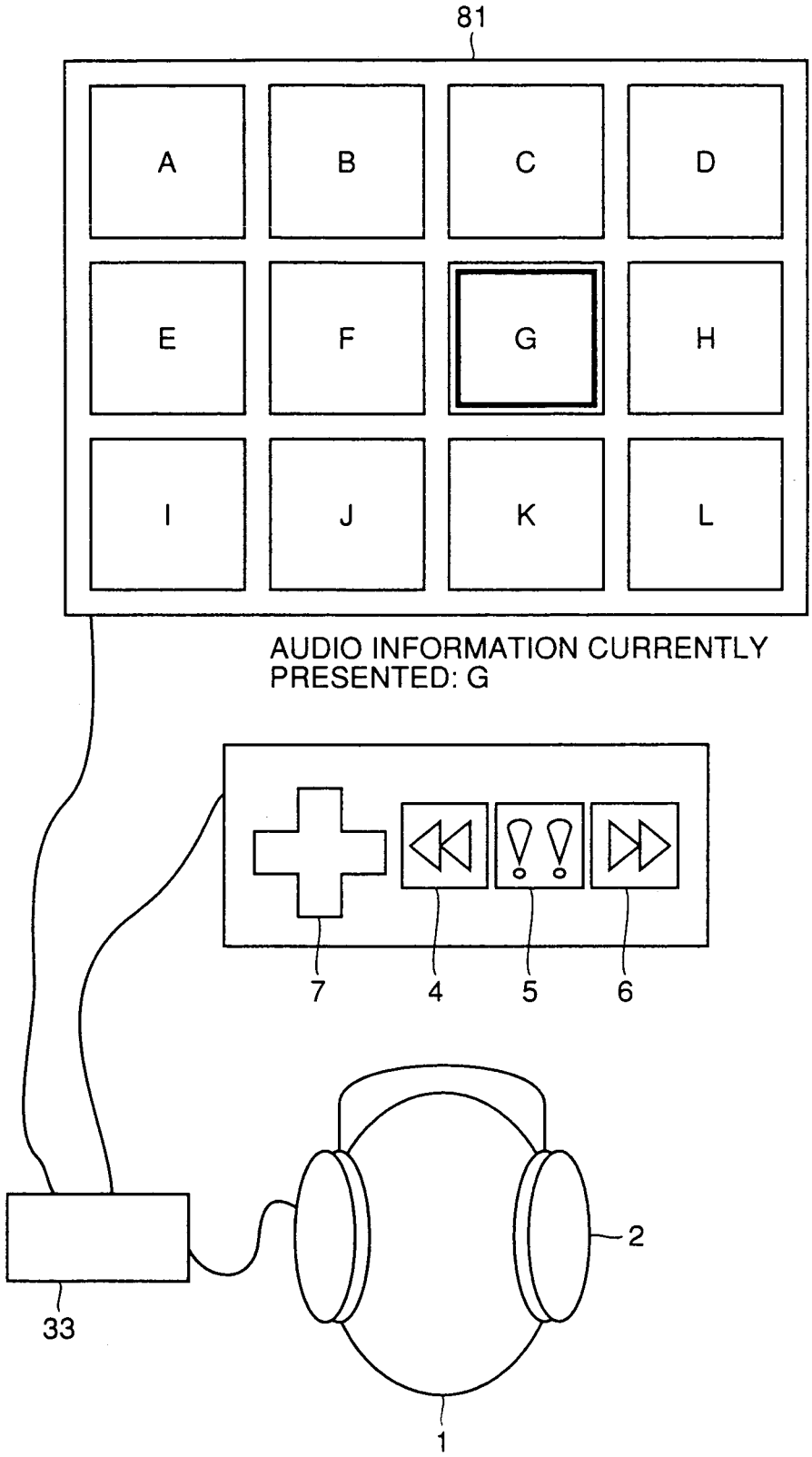
FIG. 13 is an operation image diagram according to a sixth embodiment of the present invention.

Referring to FIG. 13, user 1 listens to audio information sequentially presented by a control device 33 via headphone device 2. At the same time, control device 33 provides to a display device 81 image information associated with the presented audio information. A list of all the images for the entire information to be presented is displayed at display device 81. The display is devised so that the image information corresponding to the information that is currently presented by audio can be identified at a glance by framing the image information with a bold line or the like.

Figure 14:
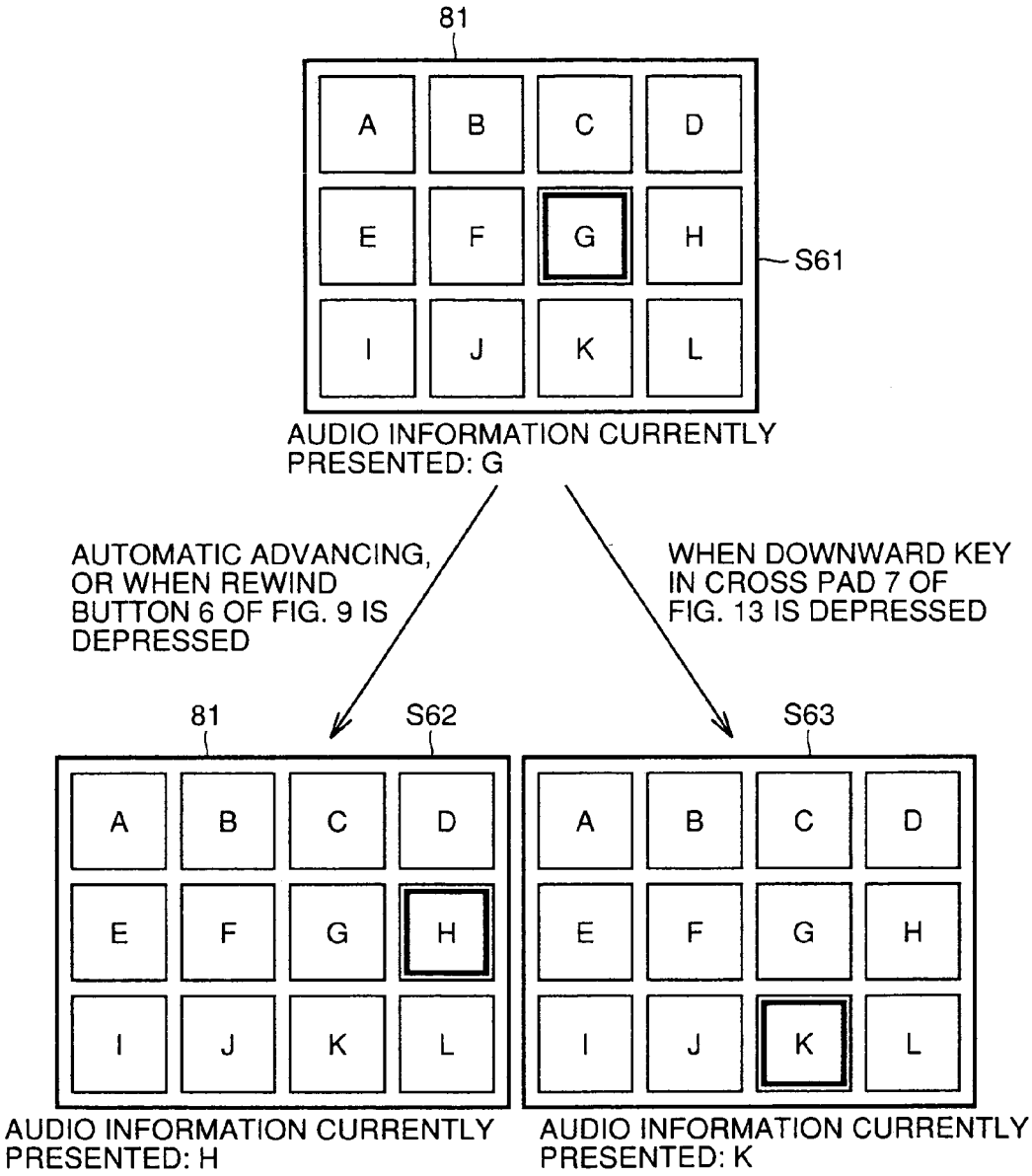
FIG. 14 shows the change in display when an image is used together in the sixth embodiment.

FIG. 14 shows the change in the screen of display device 81 when the presented information is switched. Control device 33 is implemented so that the audio information corresponding to a plurality of information sources are presented in a sequentially switched manner, and that the corresponding image information displayed on display device 81 visually attracts attention every time the presented audio is switched. One embodiment is shown in FIG. 14, wherein the image information corresponding to the information associated with the information currently presented by audio is enclosed by a bold line. Information G is presented by audio under the status of S61. Here, when there is no specification from the user, or when presentation of the next information is directed by the user by the depression of forward button 6, control device 33 presents information H, and the bold frame is shifted to surround H (S62). In the case where the user depresses the downward key of the cross pad under the status of S61, control device 33 determines that the user has specified presentation of information K displayed below G on display device 81. The audio presentation of G is suppressed and the audio presentation of K is initiated. At the same time, the bold frame is shifted to surround K (S63).

Information other than the information that is currently presented by audio can be viewed by employing the image information as described above. Also, information that cannot be specified for presentation by just one depression of rewind button 4 and forward button 6 can be specified using the cross pad. The cross pad used as the pointing device may be a shuttle ring, a jog dial, a mouse, a joy stick or the like.

Figure 15:
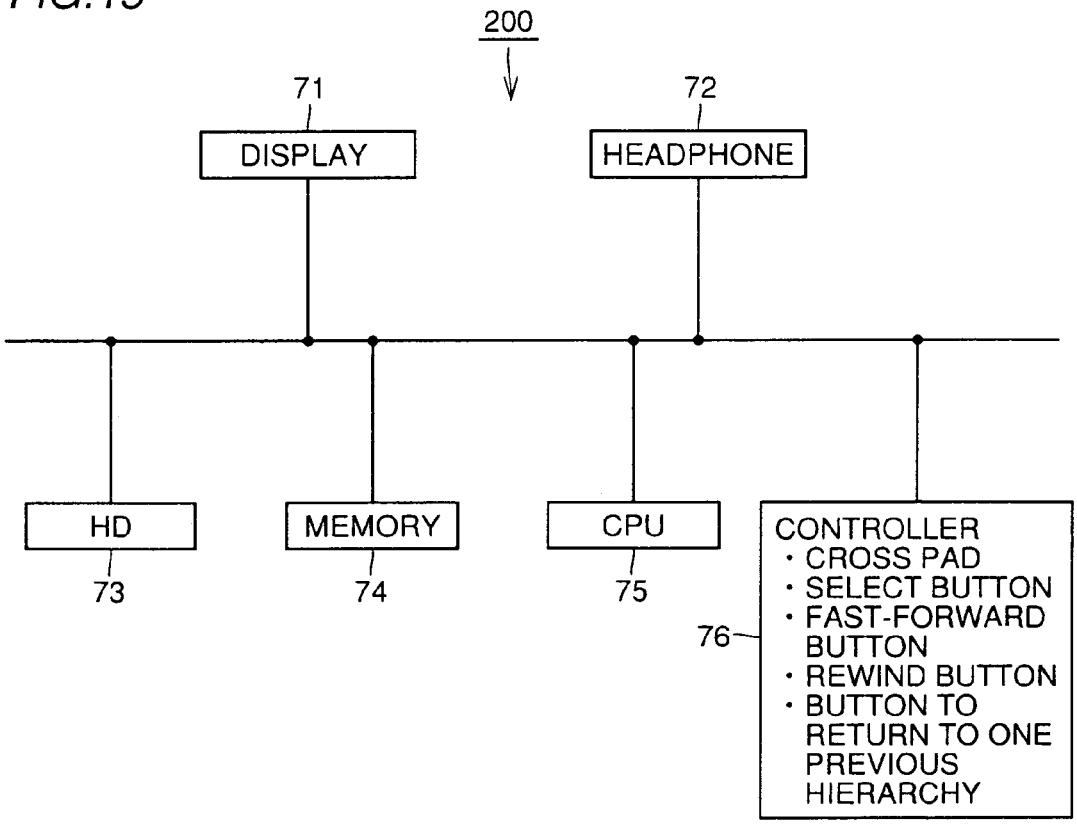
FIG. 15 is a block diagram of an audio information selection apparatus according to the sixth embodiment.

Following the description of the method of the present invention, an audio information selection apparatus according to the third to sixth embodiments will be described hereinafter with reference to FIG. 15.

An audio information selection apparatus 200 of the third to sixth embodiments includes a headphone 72, a hard disk 73, a memory 74, a CPU 75, and a controller 76 with a cross pad, a select button, a forward button, a rewind button, and a button to return to the previous hierarchy. A program is supplied via a network or from hard disk 73 in the form of a program medium to be stored in memory 74. CPU 75 reads out the program on memory 74 and supplies the information to headphone 72. Also, control is provided to emphasize the image of the information that is currently presented corresponding to the presented audio output. Upon an instruction from controller 76, CPU 75 determines that the information according to the audio information that was supplied to headphone 72 at the time controller 76 was depressed is the desired information of the user.

The present invention is applicable to a wide range as the technique of selecting a desired one out from a menu of a plurality of information in addition to the above-described mail application, CD categorizing, and multichannel broadcasting applications corresponding to the third to fifth embodiments.

Seventh Embodiment

The seventh embodiment of the present invention is basically similar to the first to third embodiments. The method of presenting the plurality of information as sound information differs from the previous-described embodiments. The block diagram and the system diagram of the audio information selection apparatus are basically similar to FIGS. 1 and 8, respectively. The system of the seventh embodiment includes an audio storage unit 111, a main control unit 112, a menu control unit 113, an audio conversion unit 114, a play control unit 115, and an information storage unit 116.

Figure 16:
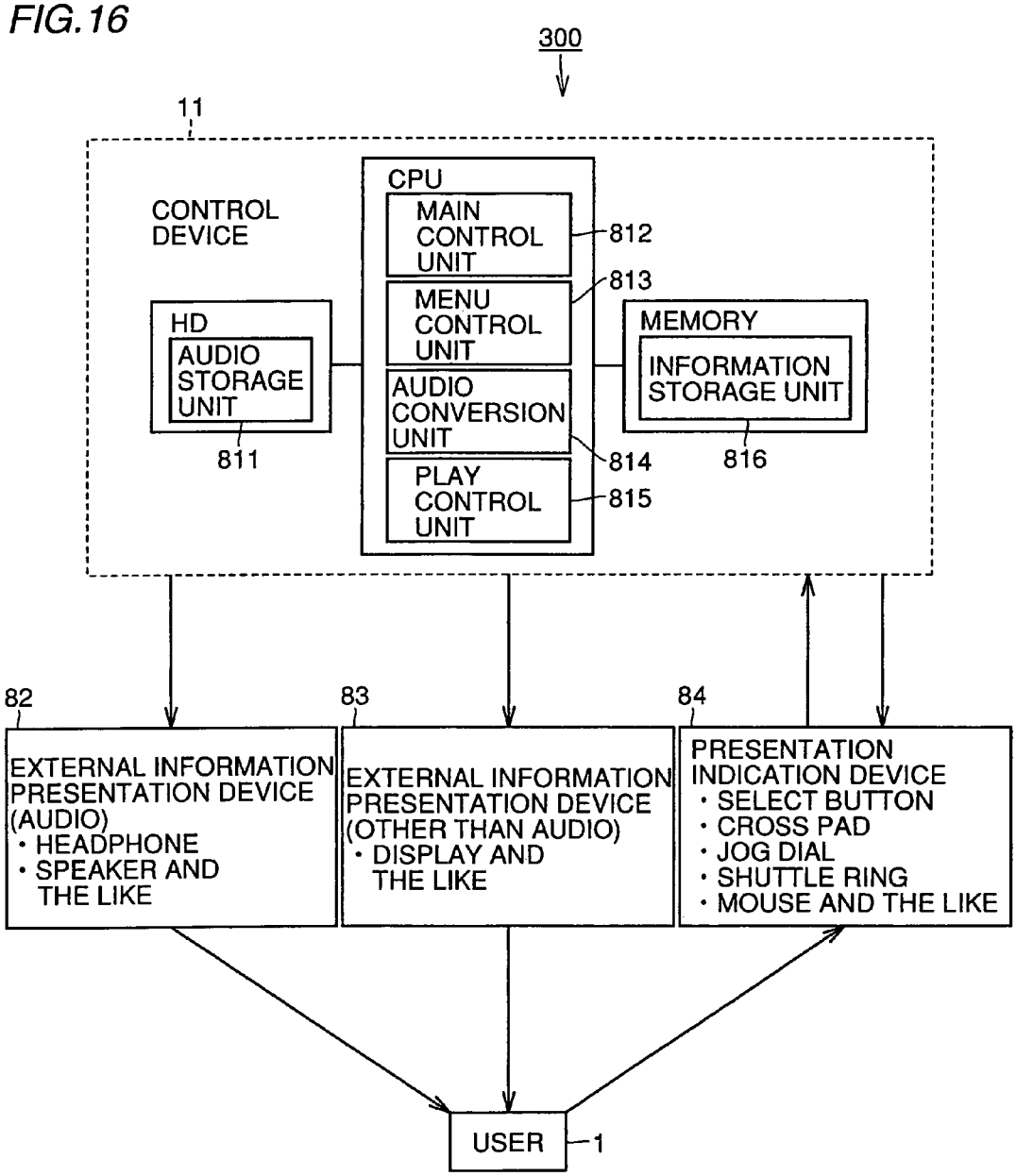
FIG. 16 is a diagram showing a structure of an apparatus according to a seventh embodiment of the present invention.

FIG. 16 is a block diagram showing the main part of an audio information selection apparatus 300 of the seventh embodiment. Referring to FIG. 16, audio information selection apparatus 300 differs from the apparatus of the third embodiment in that control device 11 includes the method of controlling the volume and placement position independently while placing a plurality of information as sound information for simultaneous playing (method 1) and the method of presenting the audio information in a sequentially switching manner (method 2). According to the information stored in information storage unit 816, a play control unit 815 is directed to play the audio information stored in audio storage unit 811 or to play the audio information which is the contents of information storage unit 816 converted by audio conversion unit 814 by appropriately switching between method 1 and method 2.

Figure 17:
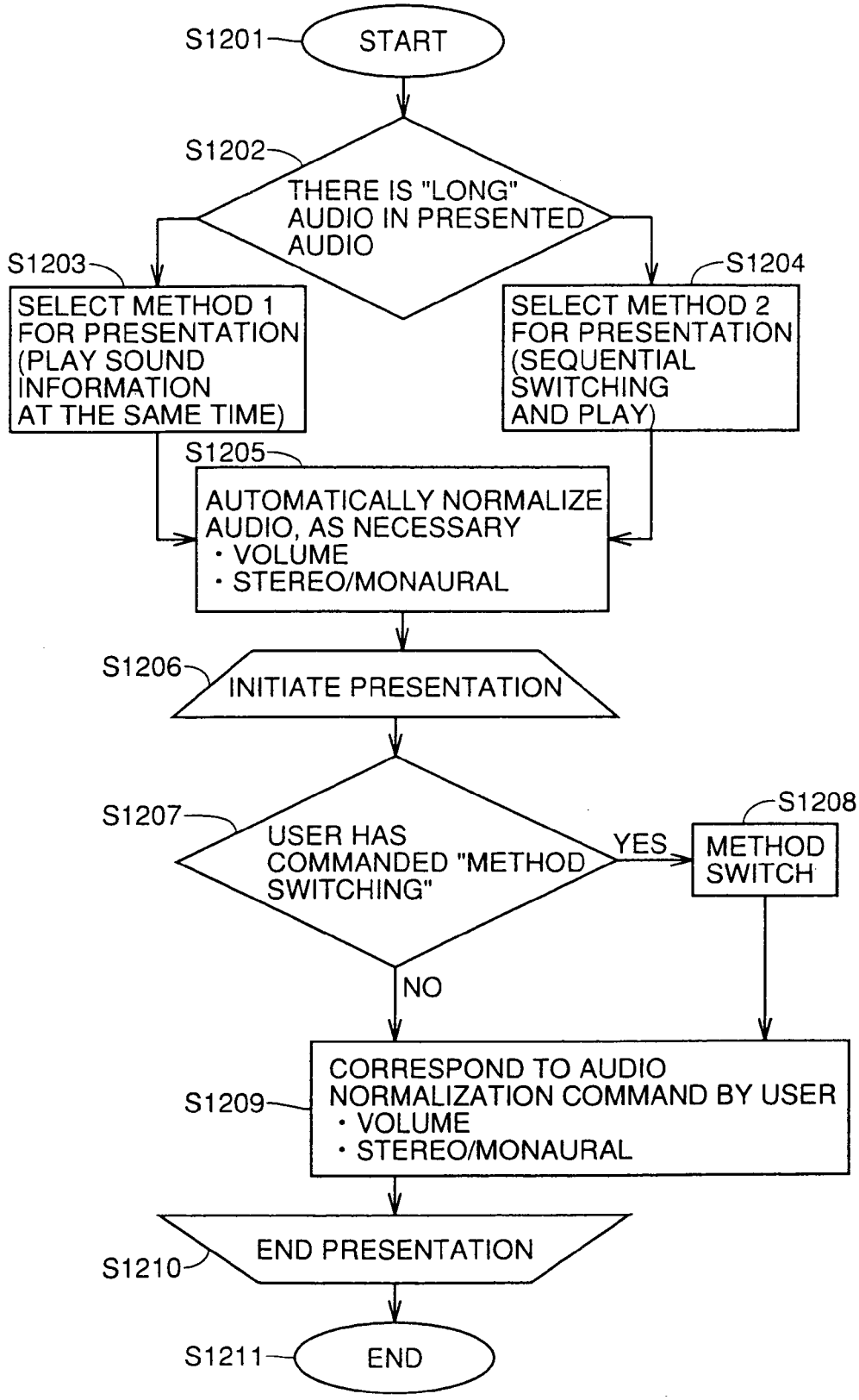
FIG. 17 is a flow chart describing switching of the information presentation status according to the information presentation apparatus of the seventh embodiment.

The flow of directing the switching of the presentation method will be described with reference to FIG. 17. Upon activation of the system in response to an instruction from the user (S1201), a series of audio information to be presented is read into the system. Detection is made whether there is audio information longer than the threshold value in the series of information to be presented (S1202). When there is a longer audio information, method 1 (simultaneous playing of sound information) is employed (S1203). Otherwise, method 2 (played in a presentation sequentially switched) is employed (S1204).

The threshold value may be a consistent value of the system, or a value set for each user according to the operation history of each user.

A step of normalizing the volume or stereo/monaural audio prior to initiating presentation can be carried out (S1205). The system executes the process automatically up to S1205, and then initiates presentation(S1206). A switching specification from the user (switching between the methods (S1207, S1208), and specifying/canceling normalization of audio parameters (S1209, S1212)) is always acceptable after initiation of the presentation and until the end of the presentation (S1210).

Figure 18:
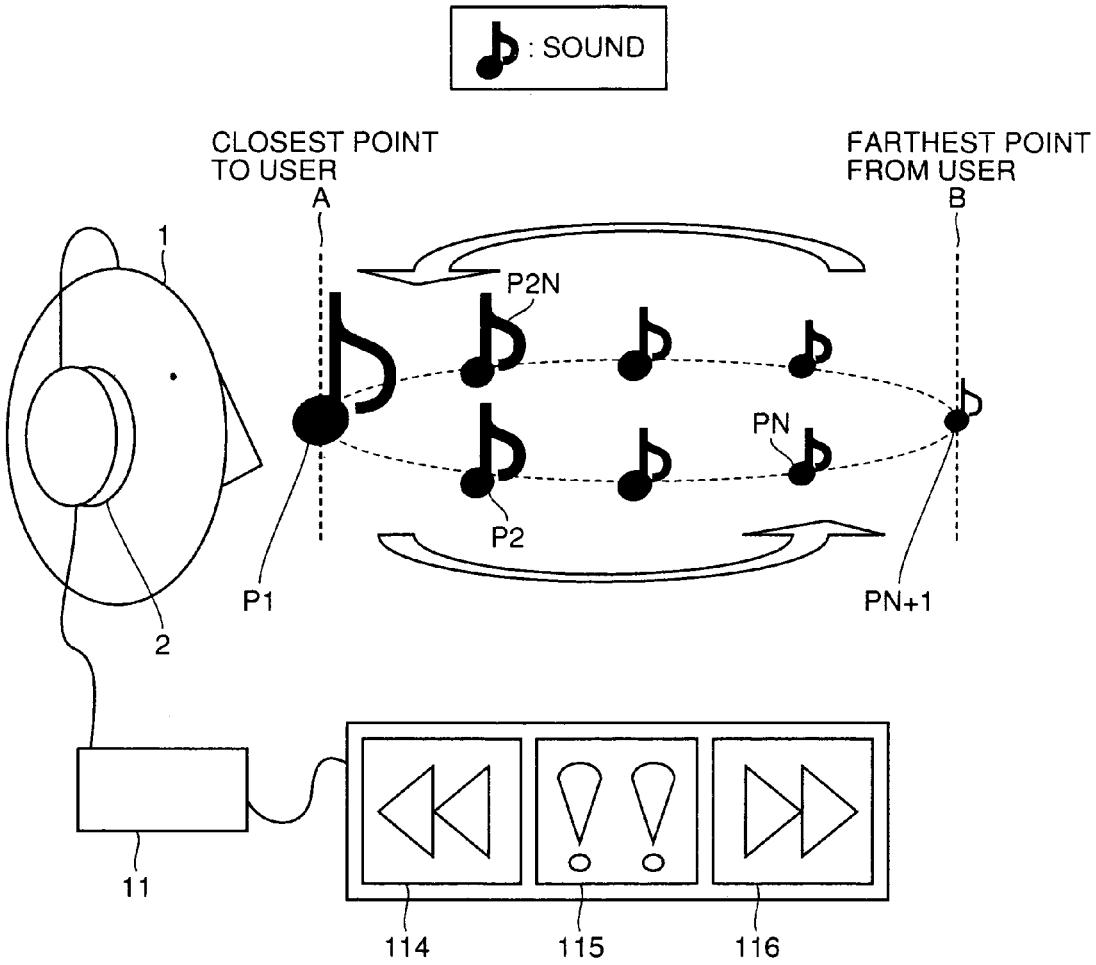
FIG. 18 is an operation image diagram of a method 1 of the seventh embodiment.
Figure 19:
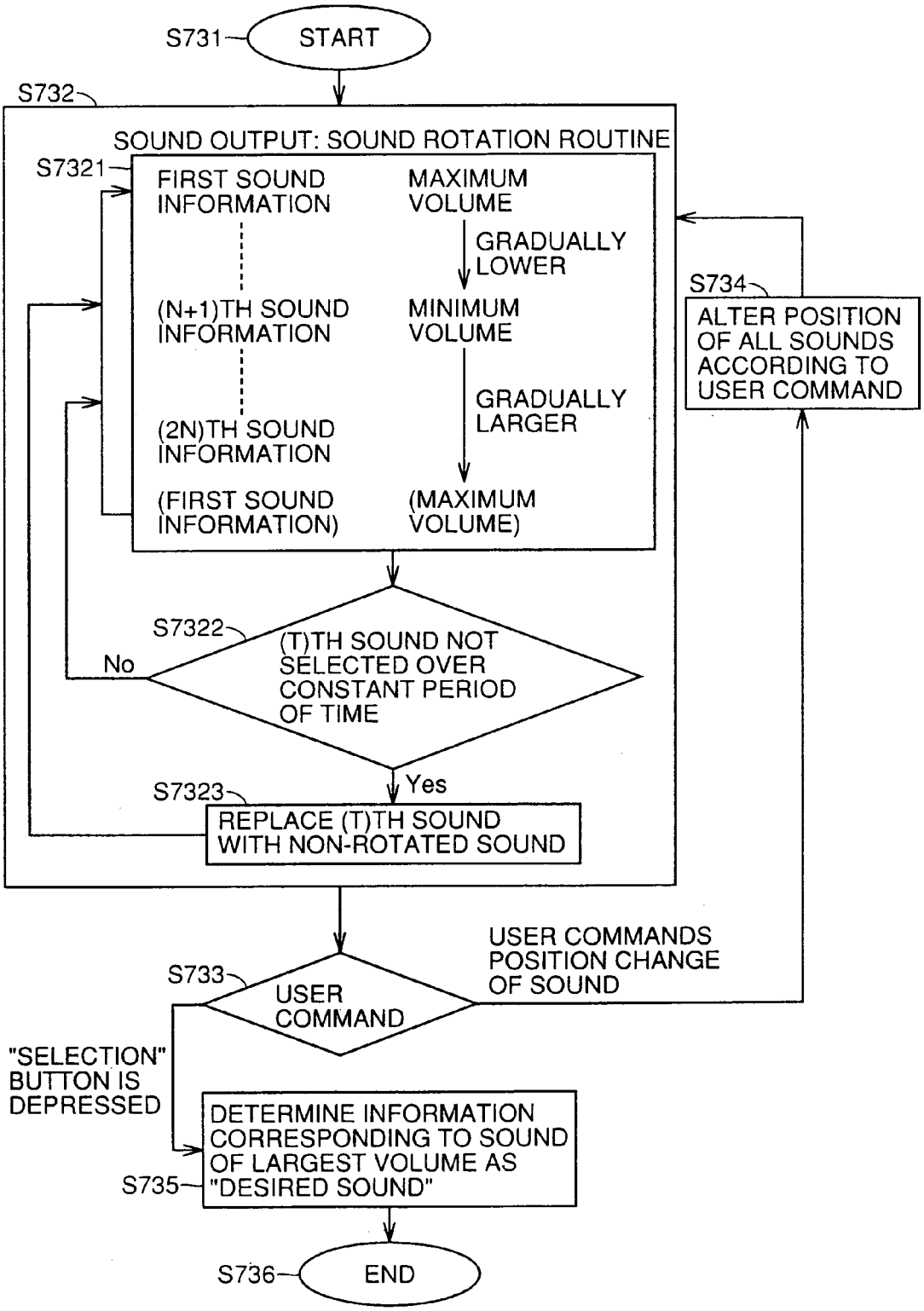
FIG. 19 is a control flow chart showing the basic operation of method 1 of the seventh embodiment.

Method 1 will be described with reference to FIG. 18 schematically showing the operation method and the flow chart of FIG. 19. User 1 listens to a plurality of sounds controlled by a control device 11 through a headphone device 2. A controller including a rewind button 4, a select button 5, and a fast-forward button 6 is provided in control device 11.

Control device 11 carries out the operation to realize the left and right volume adjustment of headphone device 2 or a stereo speaker so as to allow user 1 to recognize sounds P1–P2N located on a horizontal plane in the front direction of user 1, and provides control to effect simultaneous play as if the plurality of sounds P1–P2N at a constant interval move in an orbit. In controlling the rotation of the orbit, the volume is altered according to the rotation so that the volume of a certain sound P is set to the maximum when at a point A closest to the user and to the lowest volume when at a point B farthest from the user. The volume is repeatedly increased and lowered gradually to attain the largest volume at point A and the lowest volume at point B. The relationship of the volume of each sound in FIG. 18 is established as P1>P2> . . . >PN>PN+1< . . . <P2N, P2N<P1. This process corresponds the steps up to S7321 in FIG. 19.

Only a predetermined number of programs can be extracted to move in an orbit for selection when there are so many programs that it is difficult for a simultaneous orbital motion of all the programs such as in the case of a movie broadcast guidance of a multichannel broadcast. By replacing the sound that has not been selected over a predetermined period with information that is not yet included in the orbit at a point B most remote from the user, one information can be selected from a great many selection branches (S7322, S7323 in FIG. 19). In this case, a notify sound that does not disturb the information audit output can sounded in order to indicate that the information has been revised.

In the case where the position of the sound is to be slightly advanced or returned, fast-forward button 6 or rewind button 4 is shortly depressed, respectively, in order to control the rotation of the sound. Fast-forward button 6 or rewind button 4 is to be depressed for a rather long time when another sound is to be drawn close. The manner of button depression is not limited to this example. The position change of the sound is controlled in method 1 in response to the step indicating sound position change by the user (S733 and S734 in FIG. 19). Including the means for feedback in the button that directs position change can facilitate the perception of the user as to the moved distance of the sound position. Tactual sensation about the moved distance of the sound position by the user can be implemented by adjusting the resistance of the depression of the button.

Presentation may be devised to facilitate the usability for the user by altering the parameters related to the sound placement and rotation such as the rotation speed, the rotation radius, the distance between sounds and the like according to the length and the like of the time of play of each sound for method 1. Also, a step or means for commnding the change of the parameters on the user side can be added.

Figure 20:
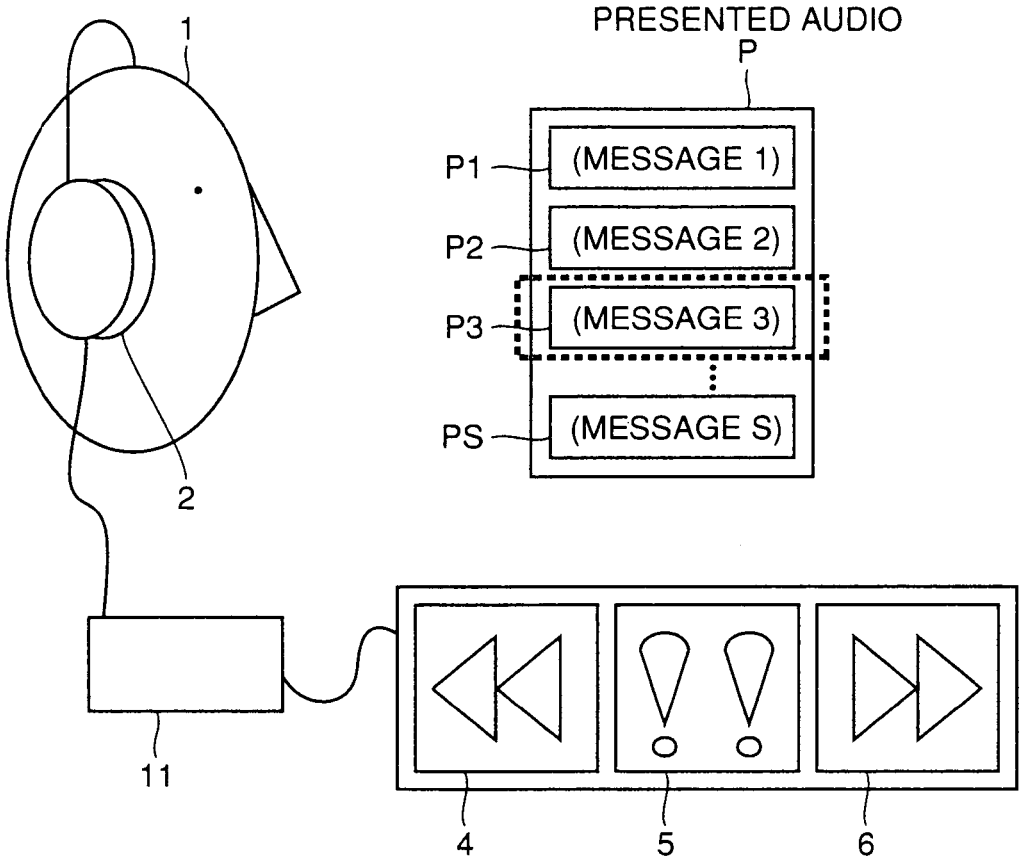
FIG. 20 is an operation image diagram of a method 2 of the seventh embodiment.

Method 2 will be described with reference to FIG. 20. FIG. 20 corresponds to FIG. 9 of the third embodiment schematically showing the operation contents. User 1 sequentially listens to the audio information presented by control device 11 via headphone device 2. Control device 11 is provided with a controller including a rewind button 4, a select button 5 and a forward button 6. Control device 11 sequentially switches the audio information corresponding to a plurality of information sources for presentation. For example, when there are a total of S information P to be presented, information P is sorted from P1 to PS. Control device 3 sequentially switches the information for presentation such as presenting information P2 following the presentation of P1, presenting information P3 following the presentation of P2, . . . .

The operation of method 2 is similar to that of the third embodiment. Therefore, description thereof will not be repeated.

The sorting sequence of the information presented to the user (arranged order) can reflect the user's preference in selecting previous information in methods 1 and 2. When there is difference in the volume of each audio to be presented, normalization can be carried out prior to presentation to play all the audio at substantially the same volume level.

It is needless to say that the sixth embodiment is applicable to the apparatuses for mails and CDs as in the fourth and fifth embodiments.

An example of employing the seventh embodiment in processing mails will be described hereinafter.

When it is not necessary to listen to the message from the beginning to the end in order to ascertain the contents of the information, depression of forward button 6 in FIGS. 18 and 20 facilitates the call up of the previous sound when in method 1 and presentation of the next information skipping the currently presented information when in method 2. When the user does not remember the contents of a previous information and wishes to confirm again the contents, depression of rewind button 4 in FIGS. 18 and 20 allows the previously-presented information to be presented again.

By employing method 1 in the case where the menu to be presented is long or when the information is to be obtained auditory while knowing the preceding and succeeding mails and by employing method 2 in the case where the menu to be presented is relatively short and each one is to be listened, information can be presented at the optimum status for the user regardless of the contents of presentation. Switching between the methods can be effected automatically by main control unit 112. Alternatively, a button for the user to specify switching can be provided so that main control unit 112 executes switching upon receiving the user's instruction.

By providing a common interface including at least a select button 5 with respect to methods 1 and 2 and additionally a rewind button 4 and fast-forward button 6, the user can obtain information with the same button and same operation even if the method is switched.

The operation of the memory is similar to that of the third embodiment. Therefore, description thereof will not be repeated.

The method of switching between method 1 and method 2 appropriately corresponding to the seventh embodiment applied to a music CD retrieval system will be described hereinafter. The normal operation is identical to that of the third embodiment.

Upon starting the system of the present application, a voice that reads out the genre as information is first presented. In the case of voice information by a guidance speech that can be presented in a relatively short time such as "Pops" and "Classic", determination is made that method 2 is appropriate. The audio information is sequentially switched and presented to the user according to method 2. In the case where music representative of each genre is employed as an index instead of the voice guidance, to determination is made that method 1 is appropriate. The sound of each music is played and moved in an orbit using method 1 to be presented to the user. In the present example, main control unit 112 switches between method 1 and method 2 depending upon the property of the audio to be presented. Information is presented to the user according to either method 1 or 2. A button that allows switching between method 1 and 2 according to the user's preference can be applied so that main control unit 112 switches between method 1 and 2 according to the user's instruction.

By providing a common interface that includes at least determination button 5 for methods 1 and 2 and additional rewind button 4 and fast-forward button 6, the user can obtain information with the same button and operation even if the method is switched.

In the case where the present invention is applied to a program guidance of a multichannel broadcast, indexes such as for each genre, target age and the like can be prepared in addition to the indexes for each channel and time to facilitate the user's selection of a desired program. The index label may be presented in the form of a synthesized speech, or in the form of the exact audible output of the program.

When a list of the programs that is currently being broadcasted is to be presented according to the method of the present invention, presentation can be provided in a fashion switching the channel for every predetermined time. Alternatively, an audio output characteristic of respective programs can be presented as the program information. In this case, when the program of a certain channel changes to another program of that same channel over time, the audio output of the new program is sequentially presented corresponding thereto.

Here, main control unit 112 can implement determination automatically to switch between method 1 or 2 such as selecting method 1 when the audio output of a program is to be directly output and method 2 when a relatively short audio output such as an index is used.

When presentation is effected using method 1 in the case where each audio to be presented is recorded at a different record level, there is a possibility of difference in volume which is one element for the user to recognize the sound placement position that "sound at a remote site is small whereas the sound at a close site is large" may be lost. Presentation can be presented without deteriorating the usability by normalizing the volume of each sound prior to presentation using method 1. By incorporating means to switch between method 1 and method 2, presentation can be provided switched to method 2 with the volume at the same level when the user decides to negate normalization of the volume level. It is also possible to provide presentation by method 1 without altering the volume level even if the audibility is slightly difficult. Thus, a user-friendly presentation means can be selected by the user corresponding to various cases.

In the case where there is audio that includes a spatial wide sense such as recording at a concert in the audio to be presented, it may be difficult for the user to identify the location of the sound when presentation is carried out by method 1 using such audio. By converting such audio including this spatial wide sense into monaural audio prior to presentation using method 1, presentation can be provided without deteriorating the usability.

The present invention affords an application of presenting candidates of home pages disclosing information preferable for the user in the form of voice in browsing the home page on WWW. More specifically, the home page can be presented in voice form by an appropriate method such as voice-synthesizing the text information on the home page, employing the music information attached to the home page, converting the color information of the home page into sound and the like.

By converting the information that is to be presented as a candidate to the user into audio by an appropriate method, information can be presented to the user by method 1 or 2 according to the property (playback time or the like) of the voiced information as audio. The user can browse any type of a plurality of information.

Eighth Embodiment

The eighth embodiment of the present invention presents information to the user both visually and audibly using visual information in a supplementary manner in addition to the auditory information of the seventh embodiment. The eighth embodiment employing visual information in a supplementary manner will be described with reference to FIGS. 21 and 22.

Figure 21:
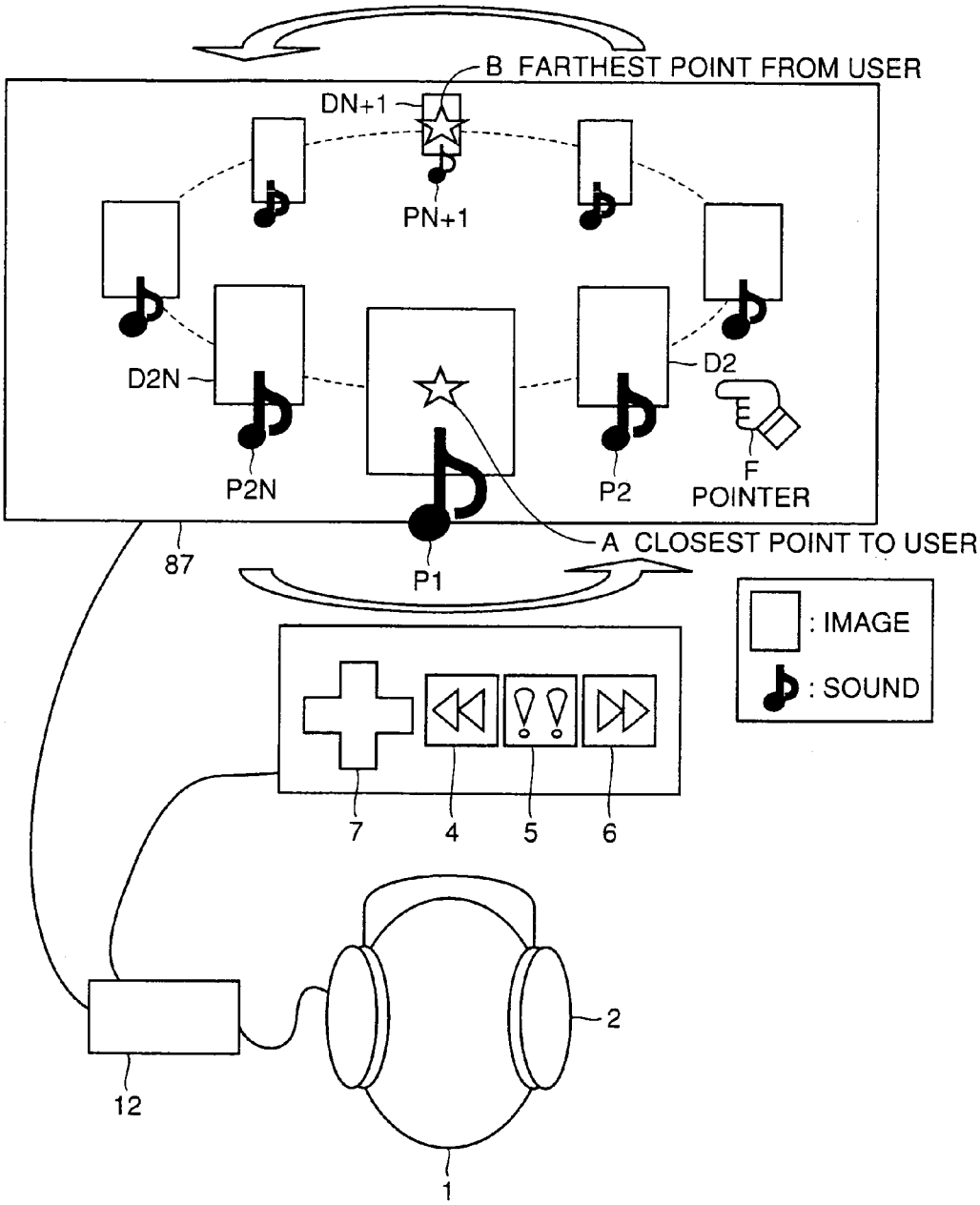
FIG. 21 is an operation image diagram of a format in which an image is employed together in method 1 according to an eighth embodiment of the present invention.

FIG. 21 is a schematic diagram showing the operation contents when visual information is employed for method 1. A controller including a rewind button 4, a select button 5, a fast-forward button 6, a cross pad 7, and a display device 87 is provided in a control device 12. User 1 views a plurality of images and listens to the sound under control of control device 12 via headphone device 2 and display device 87. Control device 12 provides control to move images D1–D2N in an orbit corresponding to sounds P1–P2N, respectively, orbiting at a constant interval in synchronization with the sound using display device 8 to display the image information. Correspondence between the volume and an image is established so that the image is displayed with the largest area when at the maximum volume. Thereafter, the volume is gradually lowered to attain the lowest level of volume. Corresponding to this change in the volume, the area of the corresponding image becomes gradually smaller than the largest area to attain the smallest area. Then, the volume and the area gradually become larger to attain the largest volume and area. Thus, identification is facilitated of which image corresponds to which sound and where the information is located. Here, the image to be presented may be a still image or a motion picture.

In the case where the user is to select information, the user operates a pointer F on display device 8 using a pointing device such as a cross pad 7, for example, to directly select an image on display device 8. Alternatively, when that user wishes to select information located at a remote site, the user waits until the desired image is exactly in front and the sound is heard at the largest volume. Instead of waiting, the user can provide control to let the desired information to be located in front and hear the sound at the largest volume using fast-forward button 6 or rewind button 4. Then, select button 5 or cross pad 7 is depressed.

Figure 22:
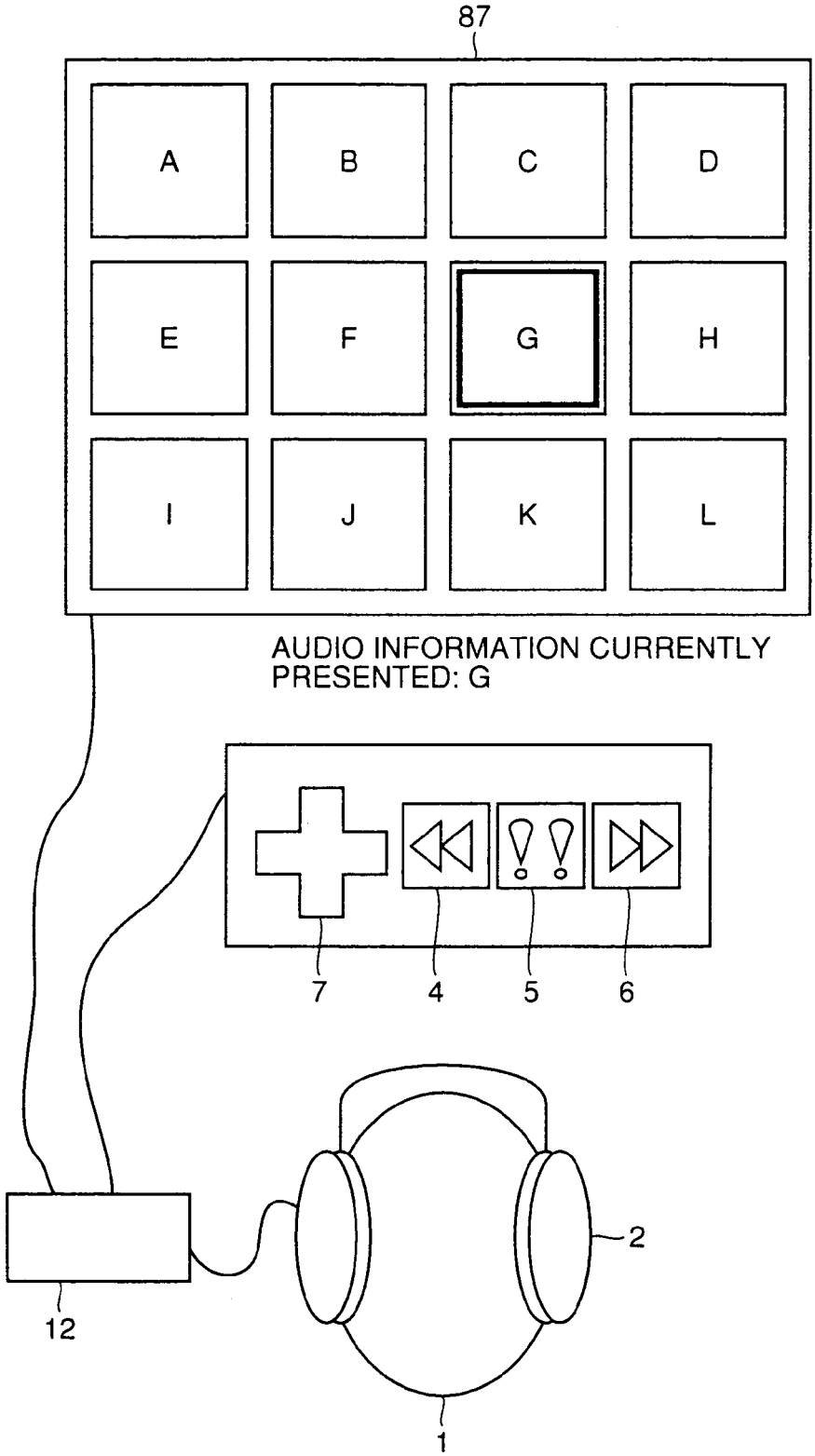
FIG. 22 is an operation image diagram of a format in which an image is employed together in method 2 of the eighth embodiment.

FIG. 22 is an image of the case where visual information is employed for method 2. User 1 sequentially listens to audio information presented by control device 12 via headphone device 2. At the same time, control device 12 provides to a display device 87 image information associated with the presented audio information. A list of all the images for the entire information to be presented is displayed at display device 87. The display is devised so that the image information corresponding to the information that is currently presented by audio can be identified at a glance by framing the image information with a bold line or the like.

The change in the screen of display device 87 when the presented information is switched is identical to that described with reference to FIG. 14. Therefore, description thereof will not be reapeated.

An audio information selection apparatus 400 according to the seventh and eighth embodiments will be described hereinafter.

Figure 23:
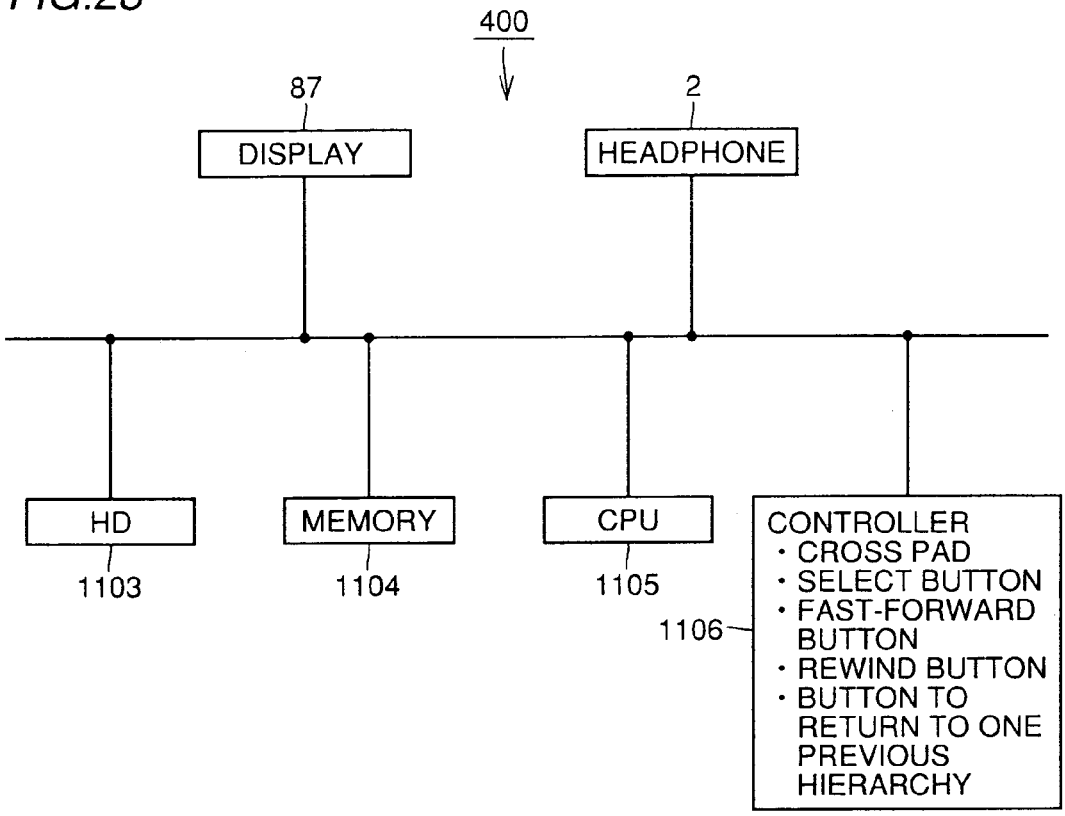
FIG. 23 is a diagram showing a structure of an apparatus realizing the eighth embodiment of the present invention.

Referring to FIG. 23, audio information selection apparatus 400 includes a display device 87, a headphone 2, a hard disk 1103, a memory 1104, a CPU 1105, and a controller 1106 including a cross pad, a select button, a forward button, a rewind button, a button to return to the previous hierarchy. A program is supplied via network or from hard disk 1103 in the form of a program medium to be stored in memory 1104. CPU 1105 reads the program on memory 1104 and supplies the read program to headphone 2. Control is provided to emphasize the image corresponding to the audio that is currently presented. The image is supplied to display device 87. Upon a command from controller 1106, CPU 1105 determines that the information corresponding to the audio information supplied to headphone 2 when controller 1106 is depressed is the information desired by the user.

Figure 24:
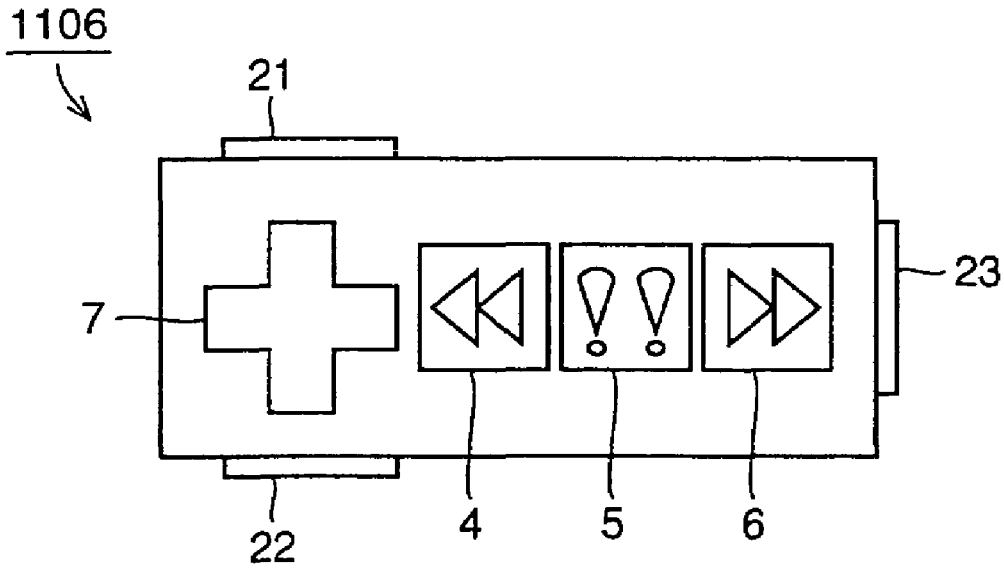
FIG. 24 schematically shows another controller according to an information presentation apparatus of the present embodiment.

FIG. 24 is another example of controller 1106 provided in the information presentation apparatus of the seventh and eighth embodiments. Controller 1106 includes any or all of a volume normalization/cancel command button 21, a stereo monaural switch button 22, and a presentation method switch command button 23 in addition to rewind button 4, select button 5, forward button 6 and cross pad 7 of controller 1106 shown in FIG. 23. The user can command the information presentation status to be modified to effect normalization when the property of the audio information to be presented differs or to group the property of the audio information such as conversion into monaural output.

The pointing device of the present invention may also have the function of repeating tactual sensation feedback according to the degree of the operation of the user. More specifically, tactual sensation feedback can be incorporated besides sound and visual recognition of the portion of information. For example, it may be generally difficult for the user to identify the location of sound even if image information is added to the audio information. The pointing device such as a track ball itself can be rotated slowly corresponding to the presentation status of the sound. By applying the tactual sensation feedback such as a smooth move when in the fast-forward operation and a move with slight resistance when in a rewind operation in moving the sound information, the user can recognize more properly the sound position. In the operation of drawing sound information near, the operability of the user side can be improved by applying some feedback such as the tactual sensation in the interface device of the pointing device in synchronization with the rotation of the sound information.

The present invention is not limited to the above-described embodiment. The present invention may be a computer-readable recording medium in which a program is recorded to cause a computer to operate as control device 3. For example, it may be any type of a recording medium such as a magnetic tape, a CD-ROM, an IC card, a RAM card or the like.

In addition to the application to mail, CD categorization, multichannel broadcasting, and WWW browsing described in the present specification, the present invention is applicable to a wide range of field as the technique of selecting a desired one from a menu selecting one information from a plurality of information.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An information selection method selecting desired information from a plurality of information represented by sounds, comprising the steps of:

storing an association between each of a plurality of information and at least one sound, time-controlling a position of each sound independently, selecting a sound, wherein said step of selecting sound includes the step of selecting information associated with sound, and controlling volume in association with the position of each sound, wherein the step of selecting information is a single operation of selecting a sound of the maximum volume, and the sound of the maximum volume is selected when the user enters a sound selection indication.

2. The information selection method according to claim 1, wherein said step of controlling the position of each sound independently includes the step of arranging the position of each said sound on a circumference of substantially a circle to move in an orbit.

3. The information selection method according to claim 2, further comprising the steps of:

commanding a position change of all of said sounds faster than a normal time control, and returning the sound to a former position.

4. The information selection method according to claim 1, wherein said step of selecting information is an operation of directly selecting a sound of interest.

5. The information selection method according to claim 1, further comprising the step of displaying an image corresponding to each information at a position corresponding to said each sound.

6. The information selection method according to claim 5, wherein said step of selecting information includes the step of selecting an image corresponding to said each sound.

7. The method of claim 1, wherein time-controlling a position of each sound independently includes time-controlling a position of each sound topic independently.

8. The information selection method of claim 1, wherein the selection step is repeated until the desired sound is selected.

9. An information selection apparatus selecting desired information, and including a sound source, said information selection apparatus comprising:

means for storing an association between each of a plurality of information and at least one sound, means for time-controlling a position of each sound independently, and means for selecting sound, wherein said sound selection means selects information associated with said sound, wherein each sound is associated with only one information, and means for controlling volume in association with the position of each sound, wherein selecting information is a single operation of selecting a sound of the maximum volume, and the sound of the maximum volume is selected when the user enters a sound selection indication.

10. The apparatus of claim 9, wherein time-controlling a position of each sound independently includes time-controlling a position of each sound topic independently.

11. The information selection apparatus of claim 9, wherein the sound selection means provides for repeatedly selecting information associated with the sound until the desired sound is selected.

12. A computer readable recording medium storing instructions, executed by a processor, to perform the method of storing an association between each of a plurality of information and at least one sound, time-controlling a position of each sound independently, selecting desired sound from a plurality of sounds, and controlling volume in association with the position of each sound, wherein selecting information is a single operation of selecting a sound of the maximum volume, and the sound of the maximum volume is selected when the user enters a sound selection indication.

13. The computer-readable medium of claim 12, wherein time-controlling a position of each sound independently includes time-controlling a position of each sound topic independently.

14. The computer readable recording medium of claim 12, wherein selecting the desired sound from the plurality of sounds further provides for repeatedly selecting desired sounds until a final desired sound is selected.

15. An information selection apparatus, based on a plurality of sounds, allowing selection of a desired signal from signals associated with respective said plurality of sounds, said information selection apparatus comprising:

sound presentation means, indication means, selecting means, and control means, wherein said signal includes at least an operation indication signal, said operation indication signal indicating an operation set in correspondence with each said operation indication signal, said sound presentation means outputs said plurality of sounds circularly in accordance with an elapse in time, said indication means provides a select indication operated from an external source to said selecting means, said selecting means selects, based on sound presented when said select indication is provided, said signal associated with said sound, and said control means performs an operation set in correspondence with said operation indication signal when said signal selected by said selecting means is said operation indication signal.

16. The information selection apparatus according to claim 15, further comprising means for commanding switching of said audio information.

17. The information selection apparatus according to claim 16, wherein said switching command means commands presentation of audio information presented after the audio information that is currently presented or presentation of audio information that is presented prior to the audio information that is currently presented.

18. The information selection apparatus according to claim 15, wherein said information source retains information other than audio information and presents said other information when the desired audio information is selected.

19. The information selection apparatus according to claim 15, wherein said information source retains information other than audio information, and sequentially switches and presents said other information in accordance with switching of said audio information.

20. The information selection apparatus of claim 15, wherein the means for selecting audio information relevant to a desired information source from the presented audio information further provides for repeatedly selecting audio information relevant to a desired information source until a desired audio information is selected.

21. The information selection apparatus of claim 15, further comprising:

sound presentation means, indication means, selecting means, and control means, wherein said signal includes an audio output indication signal and an operation indication signal, said audio output indication signal indicating output of audio contents information set in correspondence with each said audio output indication signal, said operation indication signal indicating an operation set in correspondence with each said operation indication signal, said sound presentation means outputs said plurality of sounds circularly in accordance with an elapse in time, said indication means provides a select indication operated from an external source to said selecting means, said selecting means selects, based on sound presented when said select indication is provided, said signal associated with said sound, and said control means outputs audio contents information set in correspondence with said audio output indication signal when said signal selected by said selecting means is said audio output indication signal, and performs an operation set in correspondence with said operation indication signal when said selected signal is said operation indication signal.

22. An information selection method, based on a plurality of sounds, allowing selection of a desired signal from signals associated with respective said plurality of sounds, comprising:

associating an operation with each said operation indication signal, outputting said plurality of sounds circularly in accordance with an elapse in time, providing a select indication operated from an external source, selecting, based on sound presented when said select indication is provided, said signal associated with said sound, and performing an operation set in correspondence with said operation indication signal when said selected signal is said operation indication signal.

23. The information selection method according to claim 22, wherein said plurality of information sources are categorized in advance into predetermined types, and further comprising the step of gradually narrowing down information out from categorized information sources by repeatedly employing said first and second steps.

24. The information selection method of claim 22, wherein the second step is repeated until a desired audio information is selected.

25. A computer readable recording medium storing instructions, executed by a processor, to perform the method of:

associating an operation with each said operation indication signal, outputting said plurality of sounds circularly in accordance with an elapse in time, providing a select indication operated from an external source, selecting, based on sound presented when said select indication is provided, said signal associated with said sound, and performing an operation set in correspondence with said operation indication signal when said selected signal is said operation indication signal.

26. The computer readable recording medium of claim 25, wherein the means for selecting information relevant to the desired information source from the presented audio information further provides for repeatedly selecting information relevant to the desired information source until a final desired sound is selected.

27. An information selection apparatus selecting desired information, and including a sound source, said information selection apparatus comprising:

means for storing an association between each of a plurality of information and at least one sound, means for time-controlling a position of each sound independently, and means for selecting sound, wherein said sound selection means selects information associated with said sound, wherein each sound is associated with only one information, wherein volume is controlled in association with the position of each sound, wherein selecting information is a single operation of selecting a sound of the maximum volume, wherein the sound of maximum volume is selected when the user enters a sound selection indication, wherein the selected information associated with said selected sound indicates an operation to be performed with respect to the selected sound, and wherein the operation is performed when or after the information is selected by said sound selection means.

28. An information selection apparatus selecting desired information, and including a sound source, said information selection apparatus comprising:

means for storing an association between each of a plurality of information and at least one sound, means for time-controlling a position of each sound independently, and means for selecting sound, wherein said sound selection means selects information associated with said sound, wherein each sound is associated with only one information, wherein volume is controlled in association with the position of each sound, wherein selecting information is a single operation of selecting a sound of the maximum volume, wherein the sound of maximum volume is selected when the user enters a sound selection indication, wherein at least one sound is associated with only an operation and at least one sound is associated with information to be selected, and wherein the operation is performed when or after the information is selected by said sound selection means.

29. An information selection apparatus, based on a plurality of sounds, allowing selection of a desired signal from signals associated with respective said plurality of sounds, said information selection apparatus comprising:

sound presentation means, indication means, selecting means, and control means, wherein said signal includes at least an operation indication signal, said operation indication signal indicating an operation set in correspondence with each said operation indication signal, said sound presentation means outputs said plurality of sounds circularly in accordance with an elapse in time, said indication means provides a select indication operated from an external source to said selecting means, said selecting means selects, based on sound presented when said select indication is provided, said signal associated with said sound, said control means performs an operation set in correspondence with said operation indication signal when said signal selected by said selecting means is said operation indication signal, and wherein the operation is performed when or after the information is selected by said sound selection means.

* * * * *